US008951402B2

(12) United States Patent
Timur et al.

(10) Patent No.: US 8,951,402 B2
(45) Date of Patent: Feb. 10, 2015

(54) ULTRA-FAST BORIDING OF METAL SURFACES FOR IMPROVED PROPERTIES

(71) Applicant: Uchicago Argonne, LLC, Chicago, IL (US)

(72) Inventors: Servet Timur, Istanbul (TR); Guldem Kartal, Istanbul (TR); Osman L. Eryilmaz, Plainfield, IL (US); Ali Erdemir, Naperville, IL (US)

(73) Assignee: UChicago Argonne, LLC, Chicago, IL (US)

( * ) Notice: Subject to any disclaimer, the term of this patent is extended or adjusted under 35 U.S.C. 154(b) by 0 days.

(21) Appl. No.: 13/666,528

(22) Filed: Nov. 1, 2012

(65) Prior Publication Data

US 2013/0056363 A1 Mar. 7, 2013

Related U.S. Application Data

(63) Continuation of application No. 12/470,360, filed on May 21, 2009, now abandoned.

(60) Provisional application No. 61/059,177, filed on Jun. 5, 2008.

(51) Int. Cl.

| | |
|---|---|
| ***C25D 3/66*** | (2006.01) |
| ***C23C 8/68*** | (2006.01) |
| *C23C 22/70* | (2006.01) |

(52) U.S. Cl.

USPC ..... 205/231; 205/106; 205/146; 205/149; 148/217; 148/279

(58) Field of Classification Search

USPC ..... 205/231, 106, 146, 149; 148/217, 279

See application file for complete search history.

(56) References Cited

U.S. PATENT DOCUMENTS 4,012,238 A * 3/1977 Scales ..... 148/217

FOREIGN PATENT DOCUMENTS

| | | | | |
|---|---|---|---|---|
| JP | 51-083029 | * | 7/1976 | ..... C23C 8/42 |
| SU | 1548264 | * | 3/1990 | ..... C23C 8/70 |
| SU | 1661245 | * | 7/1991 | ..... C23C 8/70 |

OTHER PUBLICATIONS

Kartal et al. "Investigating the morphology and corrosion behavior of electrochemically borided steel", Surface & Coatings Technology 200 (2006), p. 3590-3593.*

Yoshitaka et al. "Boriding of Steels by Induction Heating", Nippon Kikai Gakkai Kikai Zairyo, Zairyo Kako Gijutsu Koenkai Koen Ronbunshu, vol. 8, p. 385-386 (2000)(abstract only).*

* cited by examiner

*Primary Examiner* — Lois Zheng

(74) *Attorney, Agent, or Firm* — Foley & Lardner LLP

(57) ABSTRACT

A method of ultra-fast boriding of a metal surface. The method includes the step of providing a metal component, providing a molten electrolyte having boron components therein, providing an electrochemical boriding system including an induction furnace, operating the induction furnace to establish a high temperature for the molten electrolyte, and boriding the metal surface to achieve a boride layer on the metal surface.

20 Claims, 27 Drawing Sheets a. High Frequency Furnace
b. Direct Current Source (±0.001mA)
c. Graphite crucible
d. Multimeter (in order to measure cell potential)
e. Multimeter (in order to measure temperature)
f. Thermocouple in alumina protection tube
g. Cathode
h. Anode a. High Frequency Furnace
b. Direct Current Source (±0.001mA)
c. Graphite crucible
d. Multimeter (in order to measure cell potential)
e. Multimeter (in order to measure temperature)
f. Thermocouple in alumina protection tube
g. Cathode
h. Anode (a) 1 minute (b) 5 minutes (a) 15 minutes (b) 30 minutes (a) 50mA/cm$^2$ (b) 100mA/cm$^2$ (c) 200mA/cm$^2$ (d) 300mA/cm$^2$ (e) 700mA/cm$^2$ (a) 800°C (b) 900°C (c)1000°C $\eta = 1.25$ (a)

$\eta = 1.5$ (b)

$\eta = 1.75$ (c)

$\eta = 1.87$ (d)

$\eta = 2.245$ (e)

(a) 10% NaCl (b) 10% $CaCl_2$ (c) 10% $Na_2CO_3$ (d) 10% NaOH (e) 10% LiCl (f) 10% $BaCl_2$ 5 minutes of boriding-1500x 5 minutes of boriding -2000x 10 minutes of boriding -3500x 15 minutes of boriding -1500x 30 minutes of boriding -1500x 30 minutes of boriding -3500x 1 hour of boriding -3500x 2 hours of boriding -1500x

ULTRA-FAST BORIDING OF METAL SURFACES FOR IMPROVED PROPERTIES

CROSS REFERENCE TO RELATED PATENT APPLICATIONS

The present application is a continuation of U.S. patent application Ser. No. 12/470,360 filed May 21, 2009 which claims priority to U.S. Provisional Patent Application No. 61/059,177, filed Jun. 5, 2008. Both applications are incorporated herein by reference in their entirety.

STATEMENT OF GOVERNMENT INTEREST

The United States Government has certain rights in this invention pursuant to Contract No. W-31-109-ENG-38 between the United States Government and The University of Chicago and/or pursuant to Contract No. DE-AC02-06CH11357 between the United States Government and UChicago Argonne, LLC representing Argonne National Laboratory.

FIELD OF THE INVENTION

This invention is directed to an ultra-fast surface treatment method that results in hard, wear, corrosion and erosion resistant, and low-friction surface layers on metallic substrates. More particularly, the present invention relates to an ultra fast electrochemical boriding technique which can lead to dramatic improvements in the mechanical and tribological properties of treated metal surfaces, ferrous and non-ferrous.

BACKGROUND OF THE INVENTION

Most mechanical components used in a variety of rolling, rotating, or sliding bearing applications, as well as those that are used in metal-cutting and—forming operations, rely strongly on high hardness and low friction surface properties of base metals for high performance and durability during use. In a dusty, sandy, and corrosive environment, high resistance to erosion and corrosion becomes important. There are numerous surface treatment methods that are currently used to enhance the near-surface properties of engineering components. Some of these methods (such as nitriding, carburizing, carbonitriding, and boriding) are theremo-chemical in nature and based on thermal diffusion of carbon, nitrogen, and boron atoms into the near surface regions of these components at high temperatures. It typically takes about 8 to 10 hours to achieve case depths of 50 to 100 micrometers in the cases of nitriding and carburizing processes; and as for boriding, the case depths are much shallower (typically 10 to 15 micrometers for the same processing time). Despite its ability to produce much harder surface layers than carburizing and nitriding, boriding is not used as extensively as the other surface treatment techniques mentioned.

There are several other surface treatment methods based on the uses of laser beams such as laser shot-peening, -glazing, -cladding, as well as ion and electron beam processes such as ion-beam deposition, electron-beam cladding, and hardening that can also be used to achieve superior surface mechanical and tribological properties. Besides these methods, there are plasma-based physical and chemical vapor deposition techniques that can also produce hard surface coatings (such as TiN, TiC, etc.) on mechanical components for improved mechanical and tribological properties. Unfortunately, all of these methods require long processing times and consume large amounts of energy.

Among the many thermal diffusion-based surface treatment processes mentioned above, nitriding and carburizing are used extensively by industry to achieve greater mechanical and tribological properties on all kinds of steel components. In the case of boriding though, progress has been rather slow and at the moment, this technique has limited uses. Just like nitriding and carburizing, boriding is a surface hardening process in which boron atoms diffuse into the near surface region of a work piece and react with the metallic constituents to form hard borides. A deep diffusion layer also exists beneath the boride layers. At present, there are several kinds of boriding methods available (such as salt-bath boriding, fluidized bed boriding, pack boriding, paste boriding, gas-phase and plasma boriding) for the production of borided surface layers. These methods are based on the uses of a variety of boron-rich solid, liquid, or gaseous media. Fluidized bed-, pack-, and paste-boriding methods use solid boron containing powders (such as B4C, amorphous boron, ferro-boron, etc.) and other compounds during the boriding process, while plasma boriding uses gaseous boron compounds in a plasma environment.

All of the boriding methods mentioned above involve a high processing temperature (typically ranging from 700 to 1000° C.). These boriding methods are most appropriate for the treatment of ferrous alloys, but nonferrous and cermet-based materials can also be treated. For example, salt-bath boriding of steel substrates can be done in a complex salt bath typically consisting of 60 to 70 wt % borax, 10 to 15 wt % boric acid, and 10-20 wt % ferro-silicon or boron at temperatures ranging from 800 to 1000° C. Boriding of a low carbon steel substrate for 5 to 7 hours in such a salt-bath may result in 7 to 10 micrometer thick borided surface layers.

During boriding of steel and other metallic and alloy surfaces, boron atoms diffuse into the material and form various types of metal borides. In the case of ferrous alloys, most prominent borides are: $Fe_2B$ and FeB. ($Fe_3B$ may also form depending on the process parameters). Some of the boron atoms may dissolve in the structure interstitially without triggering any chemical reaction that can lead to boride formation. Iron borides (i.e., $Fe_2B$ and FeB) are chemically stable and mechanically hard and hence can substantially increase the resistant of base alloys to corrosion, oxidation, adhesive, erosive, or abrasive wear. Process conditions (such as duration of boriding, ambient temperature, type of substrate material and boriding media) may affect the chemistry and thickness of the borided surface layers. Due to the much harder nature of borided layers, boriding has the potential to replace some of the other surface treatment methods like carburizing, nitriding and nitrocarburizing.

Boride layers may achieve hardness values of more than 20 GPa depending on the chemical nature of the base materials. TiB2 that forms on the surface of borided titanium substrates may achieve hardness values as high as 30 GPa; $ReB_2$ that forms on the surface of rhenium and its alloys may achieve hardness values as high as 50 GPa, while the hardness of boride layers forming on steel or iron-based alloys may vary between 14 GPa to 20 GPa. Such high hardness values provided by the boride layers are retained up to 650° C. Since there is no discrete or sharp interface between the boride layer and base material, adhesion strengths of boride layers to base metals are excellent. With the traditional methods mentioned above, boride layer thicknesses of up to 20 micrometer can be achieved after long periods of boriding time at much elevated temperatures. In addition to their excellent resistance to abrasive, erosive, and adhesive wear, the boride layers can also resist oxidation and corrosion even at fairly elevated temperatures and in highly acidic or saline aqueous media.

Materials that are most suitable for boriding include all types of ferrous metals and alloys like low- and high-carbon steels, low- and high-alloy steels, tool steels, bearing steels, stainless steels, precipitation hardening steels, carburized, nitrided, and carbonitrided steels, and cast irons. Non-ferrous metals and their alloys like aluminum, hafnium, vanadium, nickel, chromium, cobalt, titanium, tantalum, zirconium, tungsten, niobium, molybdenum, rhenium, magnesium, and their alloys in particular nickel-based and cobalt-based superalloys, cobalt-chrome alloys, tungsten and sintered carbides and/or cermets can also be borided.

Because of their impressive mechanical, tribological, chemical and corrosion properties, borided surface layers can be used in a large variety of industrial applications. In metalforming dies, they can be used to protect the critical surface finish or profiles of all kinds of dies (such as punching dies, drawing dies, bending dies, hot forming, and injection moulding dies, forging dies, die-casting, extrusion dies, embossing dies, deep drawing and impact extrusion dies). They can also be used in insertion pins, rods, plungers, bushings, botts, nozzles, pipe bending devices, guide rings, sleeves, mandrels, swirl elements, clamping, chucks, guide box, metal casting inserts, orifices, springs, balls, rollers, discs, valve components and fittings, plugs, chain components, etc. They will be extremely well-suited for stainless steel and other metallic-based mechanical shaft seals used in pumping all kinds of fluids, pulps, powders, slurries, in chemical and mining industries. In the automotive or transportation fields, they can prevent seizure, galling and scuffing-related failures under severe operating conditions, and eliminate oxidative and corrosive degradation of a large variety of engine components. They can also be used in a variety of gear drives (such as bevel gears, screw and wheel gears, helical gear wheels), including gears, ball and roller bearings, tappets, valves and valve guides, power train components, piston pins, rings and liners, fuel injector components for liquid (gasoline and diesel) and gaseous fuels (like hydrogen, propane, natural gas) and other types of mechanical components in all classes of moving mechanical systems that experience heavy loading, high speeds, erosive, corrosive, and oxidative media and elevated temperatures. Other potential applications include cold and hot forging tools, extrusion tools, press tools, glass industry tools, metal-casting tools, cutters, razor blades and shaving machines, impellers used in pumps, mixers used in chemical and mining industries, ball joints, turbine and helicopter blades that are subject to sand erosion, compressor parts and foil bearings, invasive and implantable medical devices such as hip and knee joints made out of titanium, zirconium, cobalt-chrome, stainless steel, and other specialty metals and their alloys. Because of the high boron content of their near surfaces, borided surfaces can also provide an excellent substrate for the deposition of diamond and diamondlike carbon films on metallic substrates. In most cases, diamond is difficult to deposit on steel substrates; but after the boriding process such surfaces could be ideal for the nucleation and growth of crystalline diamond and amorphous diamondlike carbon films. Such duplex boride-diamond or diamondlike carbon treated surfaces can be ideal in many machining, metalforming, sealing, and biomedical implant applications.

Despite their abilities to produce much harder surface layers and superior components over other methods, conventional boriding methods mentioned above are not used extensively by industry at the moment. There are substantial problems that hinder their wider use. Some of these problems include: high-cost, long processing time, toxic emissions/byproducts, mechanical and structural degradations, and poor surface condition or finish after the boriding process. For all of these reasons, it would be desirable to develop a new and improved boriding method that is fast, inexpensive, safe, and applicable to a wide range of materials.

SUMMARY OF THE INVENTION

The present invention provides a method for producing metallic products with hard boride layers for a variety of mechanical and erosion resistant applications. The preferred method involves preparation of a molten electrolyte consisting of about 90 wt. % borates of alkaline and alkaline earth elements (such as borax) and about 10 wt. % carbonates of alkaline and alkaline-earth elements (such as sodium and/or calcium carbonate) or sodium chloride. Addition of small amounts (0.1 to 5 wt. %) of other halides (chlorides, fluorides, and iodides, etc.) of alkaline and/or alkaline-earth elements (like, LiCl, NaCl, $CaCl_2$) can have positive effects as electrolyte enhancers. Oxides, hydroxides, and carbonates of such elements may also be used to control the viscosity and melting point of the electrolyte. Furthermore, using at least one of a high frequency induction furnace, external agitation, mixing of electrolyte or vibrating/shaking of the work piece holder can help overcome diffusion barriers in the electrochemical process and thus help achieve fast boriding and thick boride layers (about 100 micrometers or more in the case of low carbon steels) with desirable mechanical properties in short processing times (for example, less than an hour). Such a procedure can also result in a more uniform boride layer thickness on the surfaces of odd-shaped or intricate work pieces.

In electrochemical boriding, graphite is often used as the crucible material. The same graphite crucible can also serve as the anode of the electrochemical cell. Due to the high temperature nature of the boriding process, the graphite crucible or anode may undergo oxidation and hence thin down or wear out after repeated uses. As an alternative approach, in our process, we can also use the metallic and/or borided forms of titanium, aluminum, zirconium, hafnium, vanadium, niobium, tantalum, nickel, molybdenum, chromium, tungsten, cobalt, iron and their alloys as anodes and/or crucible materials. Specifically, we can form a thin boride layer on the surface of these metals by reverse polarization (i.e., by making the crucible a cathode) and then switch back to the regular boriding practice by changing the polarity, switching the cathode with the anode again. In particular, the boride layers that form on titanium (and its alloys) have excellent resistance to high temperature corrosion and oxidation. They are also electrically conductive, hence they can be an ideal choice for the industrial-scale boriding operations. Alternatively, iron and its alloys can also be borided first and then used as crucibles and/or anodes. Iron borides are also electrically conductive (this is why they form thick boride layers during our boriding process). In fact, reverse polarization of anodes and/or crucibles can be done as needed if the boride layer thickness on the crucible or the anode surface is reduced or there is a need for repair of a thinned down or worn area. Such a practice will ensure long durability and hence low cost.

The thickness and composition (e.g., type of boride, such as FeB or $Fe_2B$, or $Fe_3B$, diffusion layer) of borided surface layers can be controlled to achieve performance and durability requirements of a given application. For certain applications, $Fe_2B$ could be a preferred phase due to its superior strength and toughness. During the boriding process, the boriding temperature and/or current density may be maintained low to achieve only this phase over the other. Alternatively, one can also keep the boriding duration short but leave the work pieces in the molten electrolyte for a longer duration to allow excess boron to diffuse or distribute evenly within the structure and hence stabilize the $Fe_2B$ phase over the FeB phase. Nano-to-micro scale boride phases can also be produced in a given surface region by selectively reacting diffusing boron atoms with secondary phases and/or alloying elements within that region. This allows achieving multiple objectives, such as improved mechanical properties without degrading thermal and/or electrical properties of the base material. It is also possible to partially or selectively boride the surface or a region of a work piece by various masking methods as will be discussed in Examples.

These and other objects, advantages, and features of the invention, together with the organization and manner of operation thereof, will become more apparent from the following detailed descriptions and examples when taken in conjunction with the accompanying figures described below.

DETAILED DESCRIPTION OF PREFERRED EMBODIMENTS

Figure 1A:
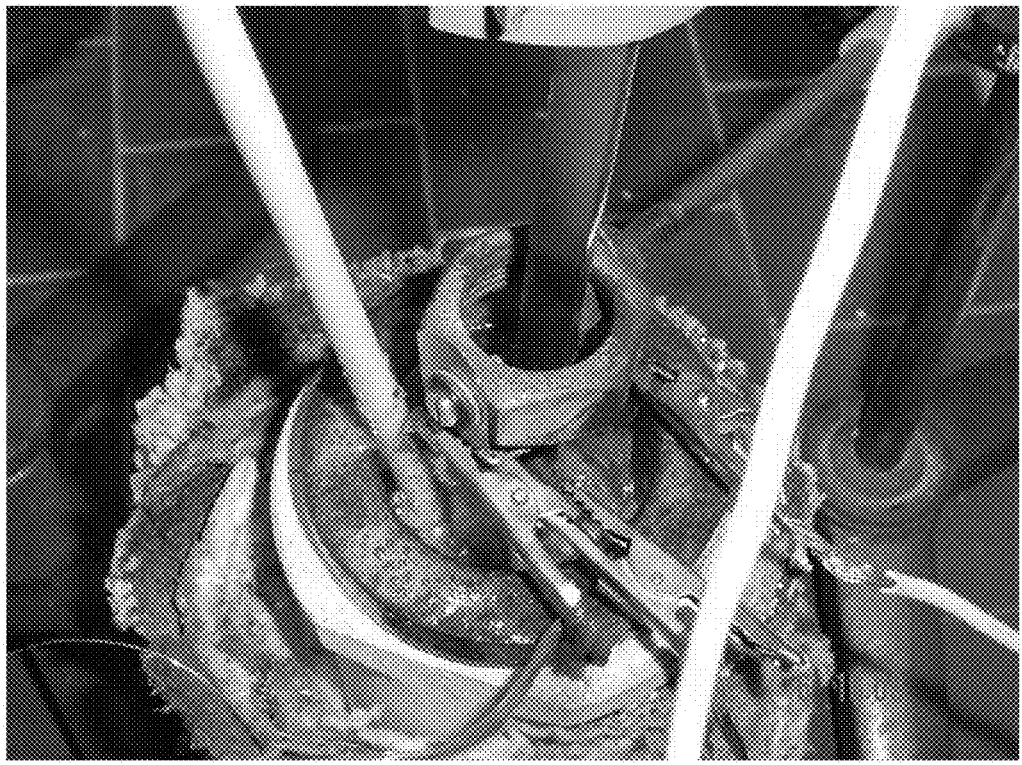
FIG. 1A is a general photograph of an electrochemical cell and FIG. 1B is a schematic of the cell used to perform boriding operations in accord with a method of the invention.
Figure 1B:
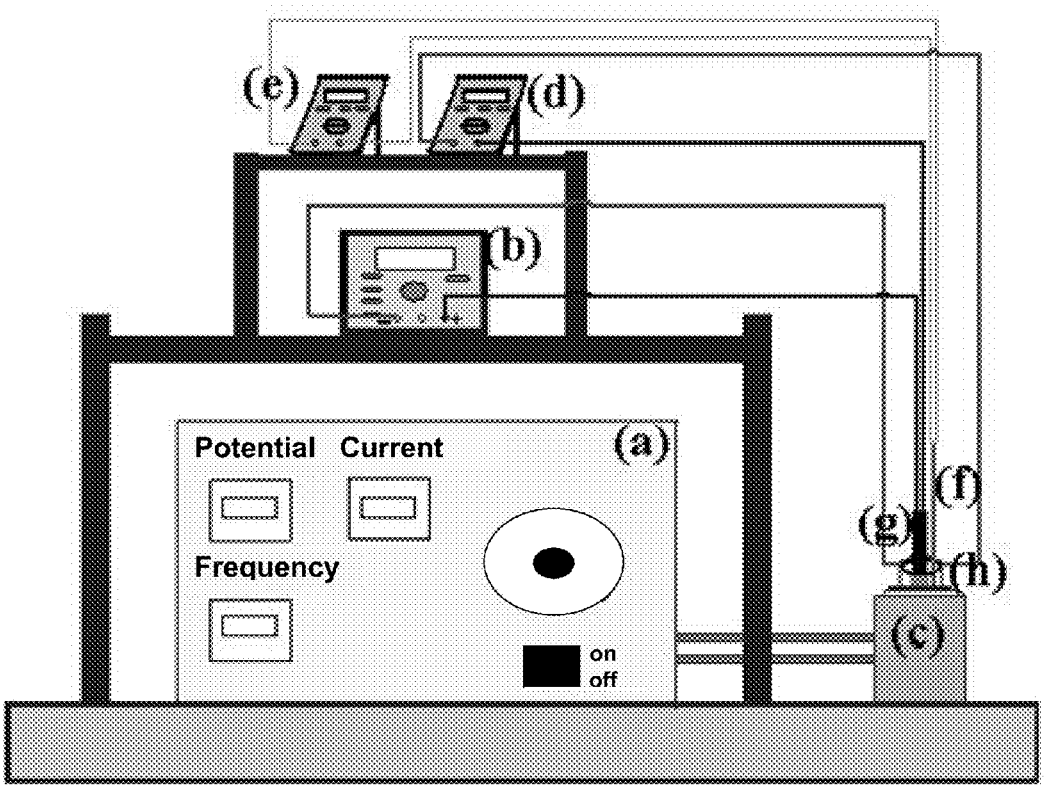

In a preferred embodiment, ultra-fast boriding is carried out in an electrochemical cell using high-temperature salt bath electrolytes that typically consist of borax and a range of inorganic sodium, potassium, lithium compounds (like $Na_2CO_3$, $CaCl_2$, NaOH, etc.). Borax is a preferred source for boron in the electrolyte but other boron sources, such a boron oxides, boric acids, potassium borofluoride ($KBF_4$), and the borates of alkaline and alkaline earth elements, as well as various boron minerals (including ulexite ($NaCaB_5O_9.8H_2O$), colemanite ($Ca_2B_6O_{11}.5H_2O$) and kernite ($Na_2B_4O_6(OH)_2.3H_2O$)) may also be used in the electrolyte. In a most preferred embodiment, the composition of base electrolyte includes borax as the main ingredient with a source for boron (most preferably between 30 to 95 wt. %) in combination with sodium carbonate (between about 5 to 70 wt. %) as the other ingredient. In addition, in a most preferred embodiment, electrolytes enabling ultra-fast boriding include some small amounts (0.1 to 5 wt. %) of alkaline and/or alkaline-earth halides (such as $CaCl_2$, NaCl, etc.). Other halides (chlorides, fluorides, and iodides, etc.) of alkaline and/or alkaline-earth elements can have positive effects as electrolyte enhancers. Oxides, hydroxides, and carbonates of such elements may also be used to control the viscosity and melting point of electrolyte. The addition of these halides into molten electrolytes results in a significant increase in the boriding rates and also refines the grain size and morphology of the borided surface layers. These halides release sufficient amounts of halide ions like Cl— into the electrolyte bath and hence increase electrical conductivity and surface transport activities on metal surfaces and also increase boron intake or diffusion. While not required for operation of the invention, it is believed that Cl ions also insure uniform current distribution across the electrolyte which can be helpful for achieving uniform case depth on intricate or odd-shaped work pieces. The halide additives also make it easy to clean the work pieces after the boriding process, since they are all water soluble. FIG. 1B shows a schematic illustration of the main components of a typical electrochemical cell. The electrolysis principles apply to larger systems than shown in this figure and FIG. 1A as long as the anode, cathode, and other components are designed and configured accordingly. The anode is made of graphite (but can also be made of all kinds of other materials that are electrically conductive and compatible with high temperature electrolytes used in the boriding process). Cathodes can be made of any type of electrically conductive materials to which the work pieces to be borided are attached by an appropriate manner.

Figure 2A:
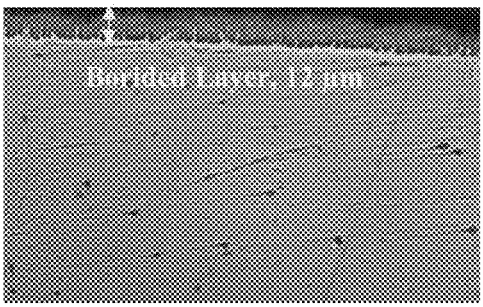
FIG. 2A shows a cross sectional micrograph after 1 minute of the boriding treatment.
Figure 2B:
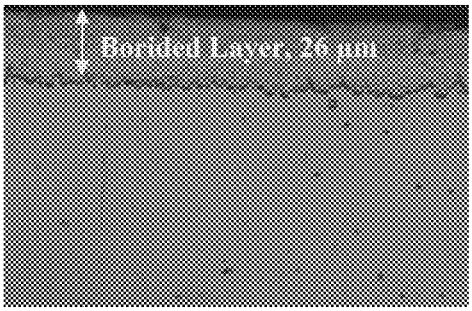
FIG. 2B shows after 5 minutes of boriding.
Figure 2C:
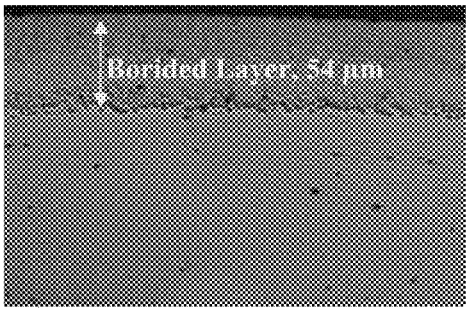
FIG. 2C shows after 15 minutes of boriding and FIG. 2D shows after 30 minutes of boriding.
Figure 2D:
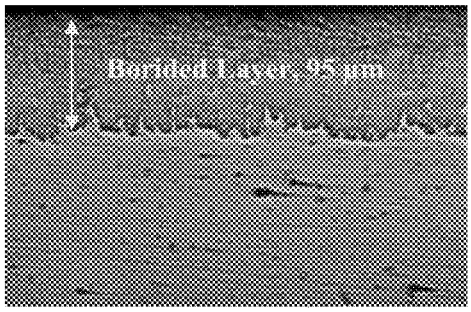
Figure 2E:
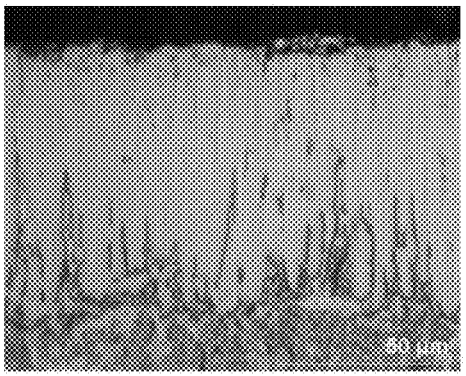
FIG. 2E shows the sample of FIG. 2C following a 45 minute soak in the molten electrolyte.

Using the system shown in FIG. 1B, a variety of electrochemical boriding treatments were performed to demonstrate the fast nature of the boriding technique. In these experiments, square-shaped substrates fabricated from a low-carbon steel plate (DIN EN 10130-99 DC04, 0.004 Carbon) were used. In one case, a molten electrolyte was prepared (composed of 10 wt % NaCl+90 wt % $Na_2B_4O_7$) and a current density of 200 mA/cm$^2$ applied to the steel substrates at 900° C. for a duration ranging from one minute to thirty minutes. Electron microscopy and X-ray diffraction methods were used to analyze the structure and chemical nature of the borided steel surfaces. Micro-hardness tests across the borided cross-sections to determine the hardness profile as a function of depth from the top surface. As shown in a series of photomicrographs in FIGS. 2A-2E, even in one minute, a fairly thick (more than 10 micrometer) boride layer is formed using the technique. After 5 minutes, the thickness of the boride layer was 26 micrometers (see FIG. 2B), after 15 minutes, the layer thickness was 54 micrometers (see FIG. 2C) and after 30 minutes, the layer thickness reached 95 micrometers (see FIG. 2D). After the electrochemical boriding treatment, the power to the electrodes may be switched off and the borided sample left in molton electrolyte for an additional time period (e.g., as short as 10 minutes and as long as 2 hours), resulting in elimination of the top FeB layer as shown in FIG. 2E.

Figure 3:
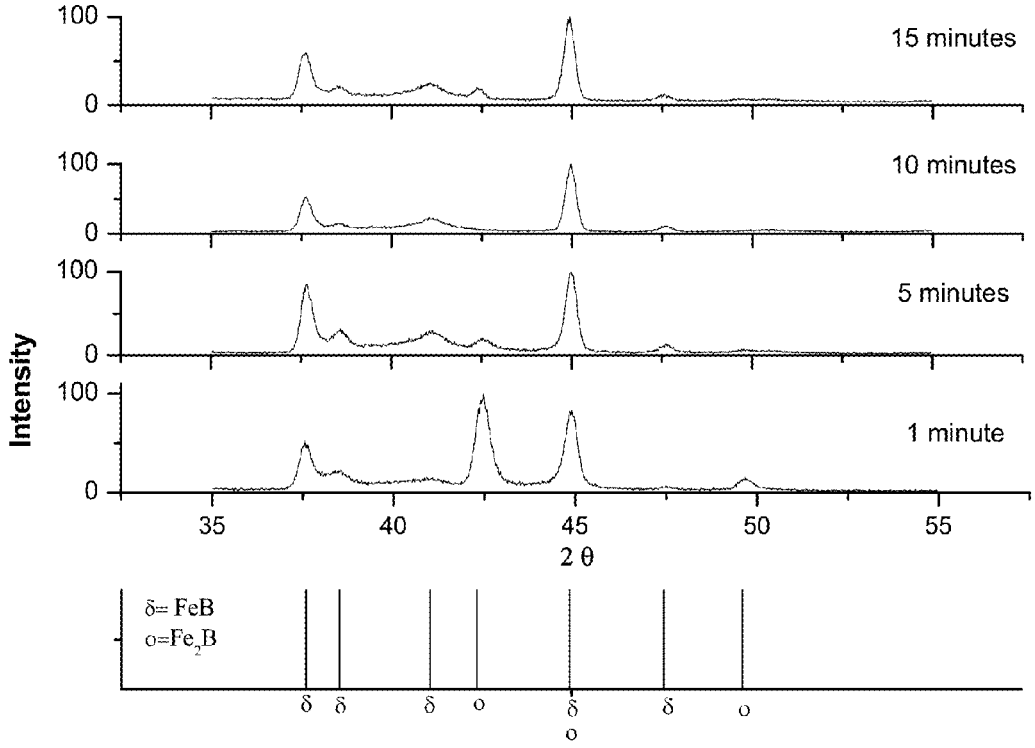
FIG. 3 shows the X-ray diffraction spectrum of boride layers formed on steel substrates for various boriding times, including 1, 5, 10 and 15 minutes, respectively, for FIGS. 2A, 2B and 2C, and also the location of the diffraction peaks for FeB and $Fe_2B$ phases (vertical lines)

X-ray diffraction analysis of the borided steel surfaces was performed using a Phillips diffractometer (Model PW 3710). As can be seen in FIG. 3, at shorter boriding durations, $Fe_2B$ is the most dominant phase, but with longer boriding time, FeB phase begins to dominate while $Fe_2B$ decreases in intensity. It is possible that near the interface, the $Fe_2B$ phase is still dominant but X-ray signals from such deep regions may have been weak or not available. Overall, the thickness or proportion of each boride phase in the borided surface layers is dependent on several parameters. For example, the thickness of the $Fe_2B$ phase can be controlled by the selection and manipulation of different process parameters, including the temperature of the electrolyte, current density and applied voltage, the duration of the boriding process, the chemical composition of the electrolyte, and length of soak time in the molten electrolyte following the electrochemical boriding process. As shown in FIG. 2E, this layer can be totally eliminated by leaving the borided samples in the electrolyte for an additional time period.

Figure 4:
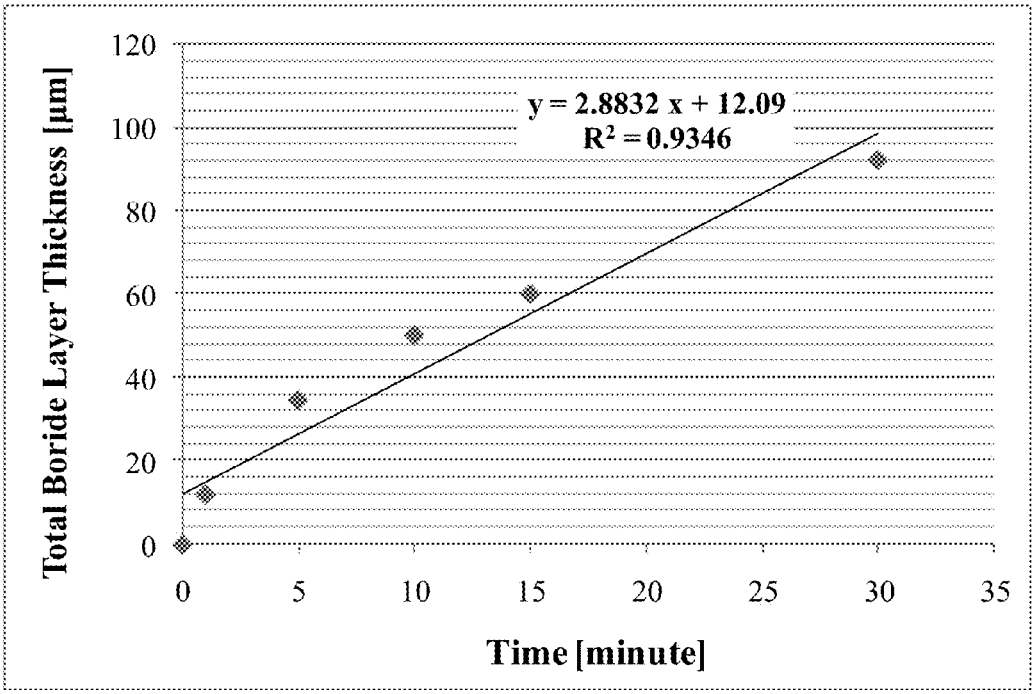
FIG. 4 shows the variation of boride thickness with time in minutes.

As shown in FIG. 4, the boride layer grows almost linearly with boriding time. Specifically, the thickness of borided layers with respect to boriding time is: 12 μm after 1 minute, 26 μm after 5 minutes, 54 μm after 15 minutes and 95 μm after 30 minutes. These data points can be represented in a formulae like: $d=2.8832*t+12.09$ where d is the thickness in micrometers and t is the boriding time or duration in minutes.

In this boriding process, the $NaO/B_2O_3$ ratio was also optimized by using additional salts (such as $Na_2CO_3$ and $CaCl_2$) in the electrolyte bath. The reduction of $Na^+$ and/or $Ca^{++}$ ions on the cathode surface may be a key step; through this reduction, a significant amount of boron reduction in the molten salt bath is achieved and hence the diffusion of boron into the metal has been accelerated. Again, as is clear from FIG. 4, boriding depth increases linearly with time in the first 30 minutes. Similar results can be achieved on other metallic or alloy systems by preparing and using highly optimized salt bath compositions. In this example, we used a high frequency induction furnace for not only heating but also mixing the electrolyte continuously during the boriding process. Heating or melting of the electrolyte can also be done by electrical resistance heating, external gas fires or burners or any other means that can provide necessary heating to the electrolyte. Mixing of molten electrolyte can be done by vibration of the work piece holder or cathode, or by ultrasonic, magnetic, or mechanical mixing of the electrolyte by an appropriate mixer. The rotation of the work piece or cathode may also provide sufficient mixing of the electrolyte and hence faster diffusion of boron atoms into the work pieces. An induction furnace can externally be used to provide mixing of the electrolyte as well, while melting of the electrolyte is done by resistive or flame heating. Mixing or agitation of the electrolyte during boriding significantly influenced borided layer thickness and the proportion of each boride phase in the borided layer. For example, without any type of mixing or vibrating, after 2 hours of boriding, a boride layer thickness of about 150 micrometers is achieved in a low carbon steel sample. When the steel sample is rotated at a speed of 50 rpm under the same process conditions and time, the layer thickness reached 180 micrometers. If a high-frequency induction furnace is used, the layer thickness became 215 micrometers under the same process condition and duration.

Figure 5:
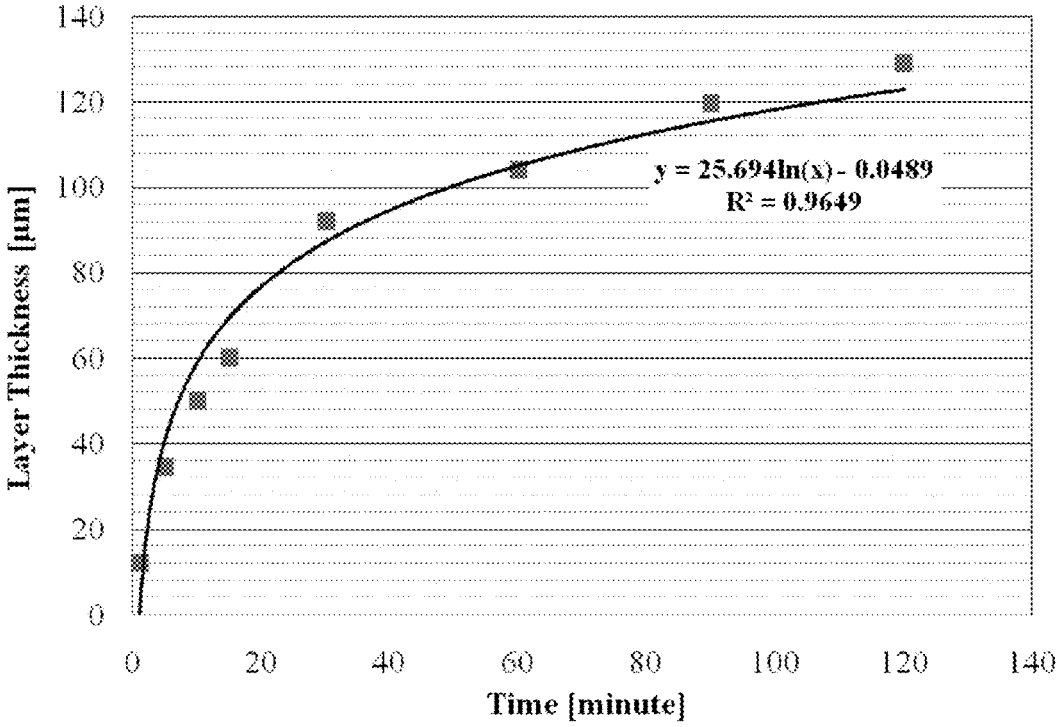
FIG. 5 shows the variation in boride layer thickness (micrometers) with time (minutes) up to a boriding time of 120 minutes under the same boriding condition as in FIG. 2.

Increasing the boriding time further (say to 60, 90, and 120 min), the nearly linear relationship between borided layer thickness and boriding time is lost. At such longer boriding times, the boride layer thickness continues to increase, but not at a linear rate as shown in FIG. 5.

Figure 6:
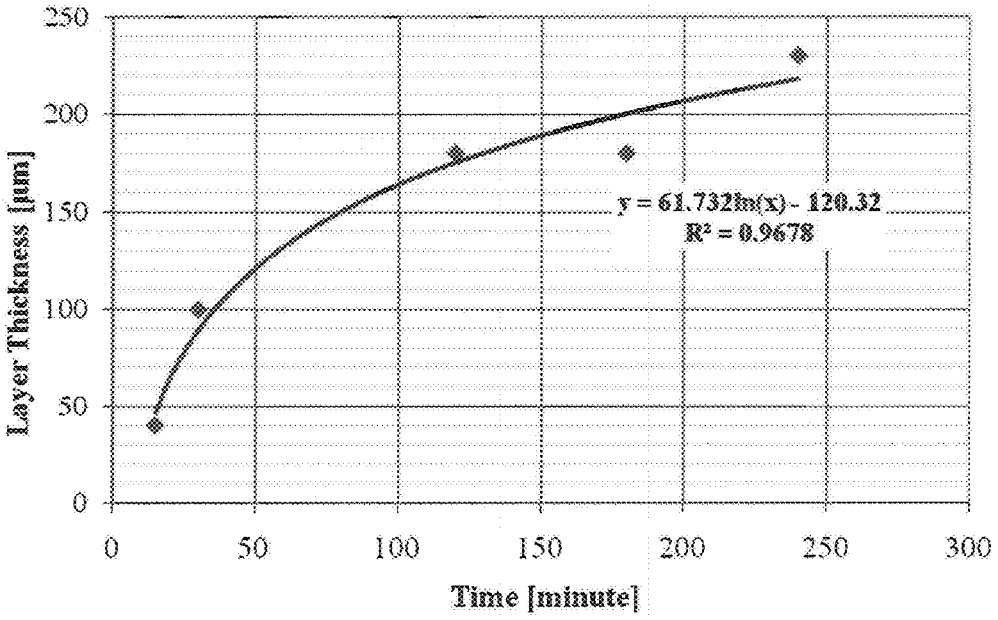
FIG. 6 shows rate of boriding of a low carbon steel substrate for an anode to cathode distance of 1 cm.
Figure 7:
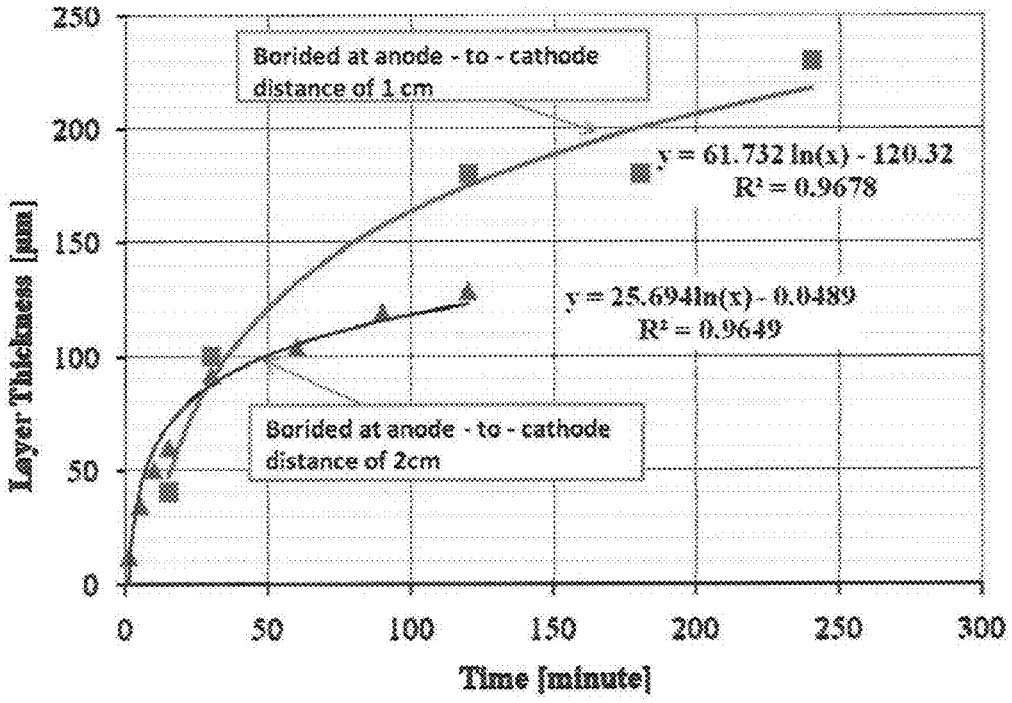
FIG. 7 shows a comparison of boride layer thicknesses with respect to anode to cathode distances as a function of time; for thicker boride layers, shorter distances give a faster boriding or higher boriding rates.

It has also been confirmed that the distance between the anode and cathode (specimen or specimen holder) is important. Specifically, this distance has a dramatic effect on the boriding rate especially when an induction or electrical heating system is used. The results shown in FIG. 4 were obtained from a set-up where the distance between the anode and cathode was 2 cm; and the electrolyte consisted of NaCl. However, similar results are obtained with other halides and or carbonates of the alkali and alkaline-earth metals. Further, when this distance is reduced to 1 cm, much faster boriding rates and boride thicknesses as shown in FIG. 6 were achieved in an electrolyte which consisted of $Na_2CO_3$. In fact, if boriding is continued for a duration of 4 hours, the boride layer thickness becomes 230 micrometers in the same electrolyte. FIG. 7 compares the results shown in FIG. 5 (for greater anode-cathode distance) and to FIG. 6 (shorter anode-cathode distance).

In another aspect of the method of the invention, stirring or agitation of electrolyte or vibrating and rotating the work pieces during the boriding process increased the boriding rate and insured a uniform layer thickness in intricate or odd-shaped samples.

Figure 8:
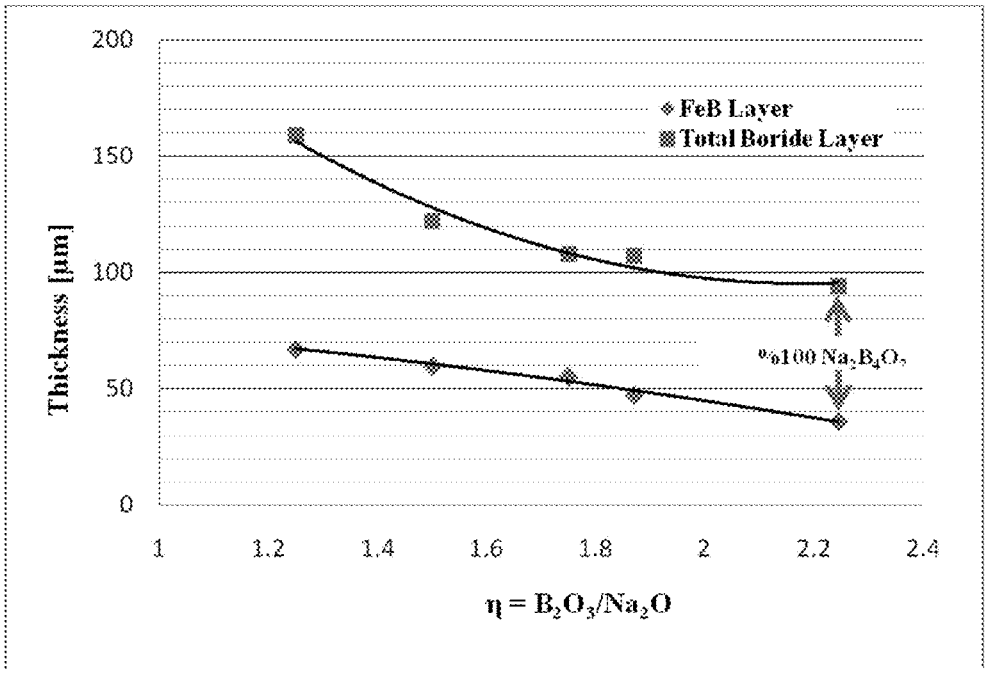
FIG. 8 shows the relationship of $B_2O_3/Na_2O$ ratio to FeB and total borided layer thickness for a fixed boriding time of 60 minutes.

In another feature of the invention the boriding rate was determined to be a function of the ratio of $B_2O_3/Na_2O$. This ratio can be adjusted, and appropriately optimized, by introducing additional compounds such as $Na_2CO_3$ and $CaCl_2$. Reduction of $Na^+$ cations on the cathode surface may be a key step for the release of boron atoms. Specifically, through this reduction, a significant amount of boron is reduced to elemental form which eventually diffuses into the work piece and thus accelerates the boriding process. As shown in FIG. 8, as the $B_2O_3/Na_2O$ ratio decreases, the thickness of the total boride and FeB layers increases substantially for the same duration (in this case, about 1 hour).

Figure 9:
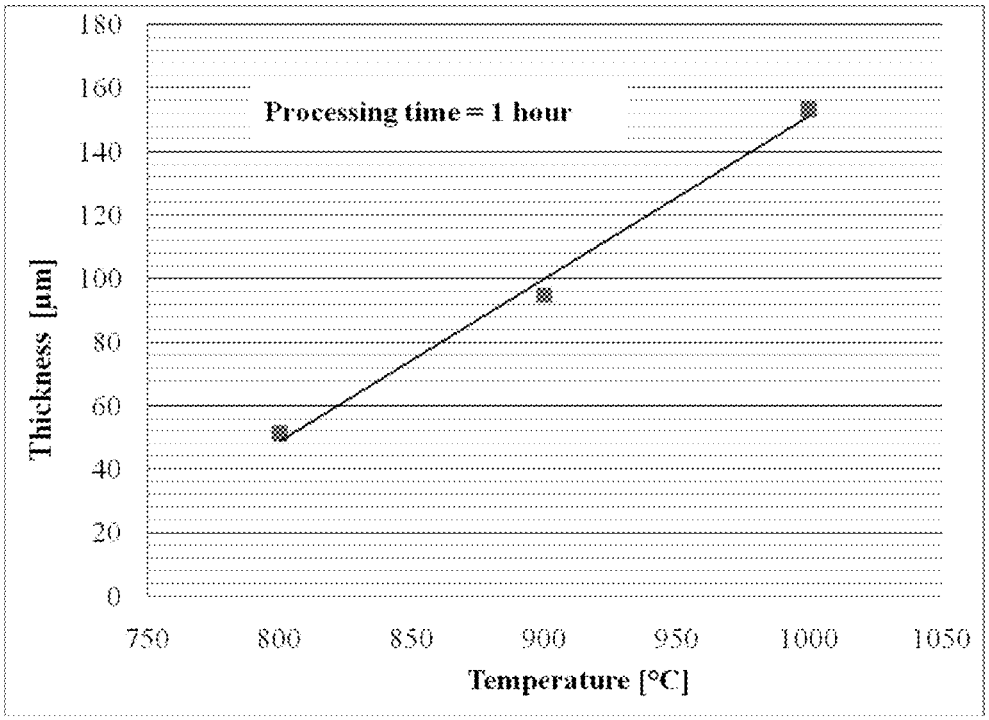
FIG. 9 shows the relationship of boriding temperature to boride layer thickness for a fixed boriding time of 1 hour.

It was also determined that boriding temperature has a strong influence in the rate of boriding. As shown in FIG. 9, for steel substrates, the higher the boriding temperature, the thicker the boride layer. Note that this trend may be different for different metals and alloys. At 800° C., the thickness of the boride layer is about 50 micrometers, but when the temperature is increased to 1000° C., the boride layer thickness reaches more than 150 micrometers for the same boriding time. A 700 to 1100° C. temperature range is most appropriate for iron-based alloys. At much higher temperatures, there may be some complications related to process control/handling and safety. Durability of anode materials may also degrade. Also, certain steels may undergo undesirable structural/chemical changes at such high temperatures. For high-carbon or carburized steels, borided work pieces may be quenched directly from such boriding temperatures to achieve a martensitic structure beneath the borided surface layers. Such a combination of a hard martensite phase with hard boride layer on top could be desirable for demanding mechanical applications.

The variable or high-frequency induction furnaces can also be used for achieving a faster boriding rate in steel and other alloys. Such furnaces not only heat, but also vigorously agitate or mix, the molten electrolyte and hence increase the chances for free boron atoms to reach the surface of work pieces and hence diffusing into the structure.

Another feature of the invention for improved boriding is to maintain a clean surface (particularly free of organic contaminants or oxide layers). A brief grinding with 200 to 800 grit emery papers seems to be effective in removing such contaminants and hence increasing the boriding rate. Sometimes, applying a reverse polarity to work pieces (e.g., making them the anode for a short period) also seems to be effective in cleaning the work piece surfaces. Other important parameters that can influence the rate and quality of boriding are: current density, type of anode materials and their positions in the bath, roughness and cleanliness of the work piece surfaces, and geometric shape of the work piece.

Figure 10B:
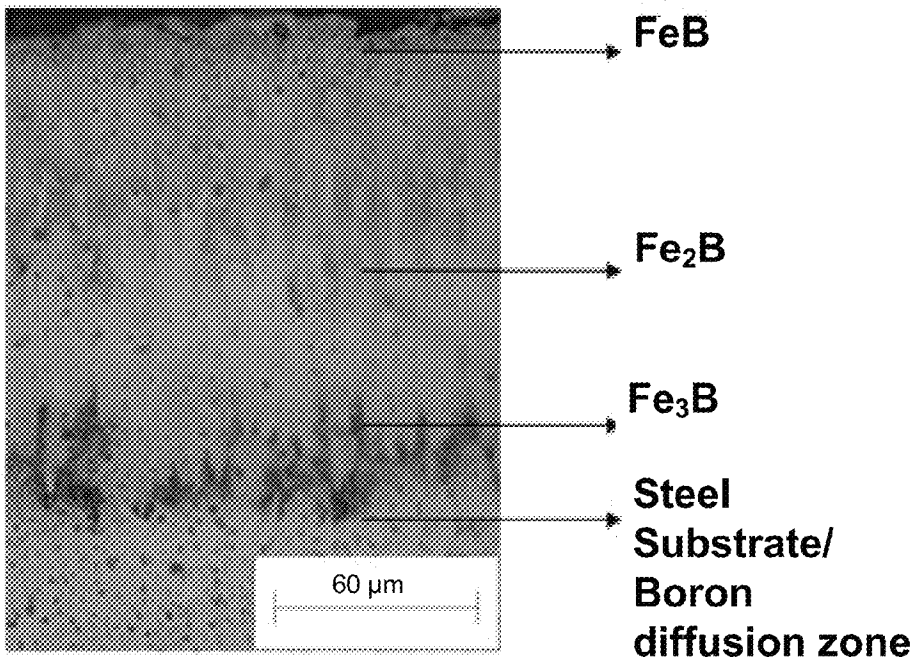
FIG. 10B is a micrograph cross-section at one magnification for a steel specimen with different iron boride phases borided for 60 minutes.
Figure 10A:
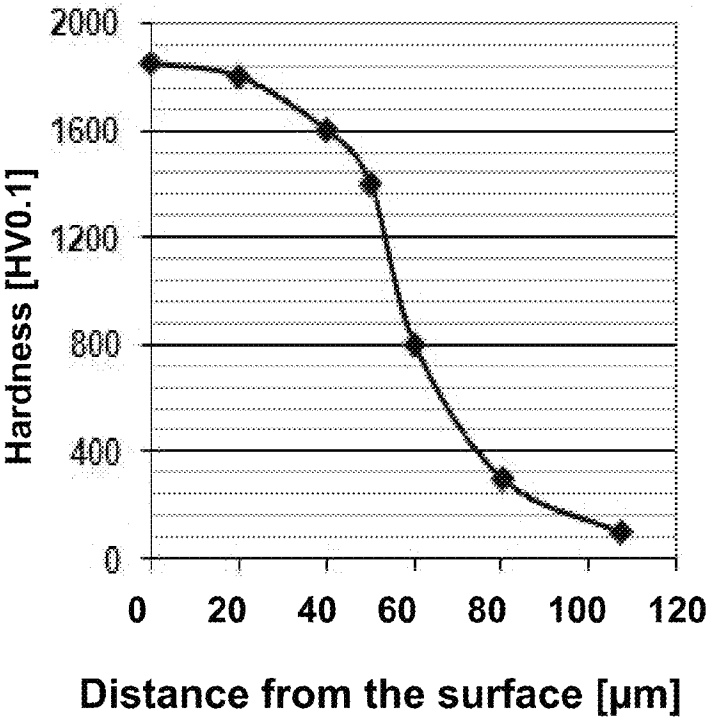
FIG. 10A shows hardness profile as a function of distance from the surface (beneath the boride layer is a boron diffusion zone)

Micro hardness testing of borided surfaces in cross-section revealed a significant increase in their hardness. Specifically, the typical measured hardness values of borided top layer were in the range of 1500-1900 HV, whereas the hardness of un-borided steel was ≈100 HV as shown in FIG. 10A.

These and other objects, advantages, and features of the invention, together with the organization and manner of operation thereof, will become more apparent from the following non-limiting examples when taken in conjunction with the figures described hereinbefore.

Example 1

The Effect of Boriding Time on Boron Layer Thickness

The following Tables I and II show the relationship between total boride and FeB layer thickness and boriding time. (Electrolyte composition: % 10 NaCl+% 90 $Na_2B_4O_7$; Current density: 200 mA/cm$^2$; Temperature: 900° C.). After the electrochemical boriding treatment, by switching off the power to electrodes and leaving the borided sample in the molton electrolyte for an additional time period (e.g., as short as 10 minutes and as long as 2 hours), the top FeB layer may be eliminated.

TABLE I

| | Time | | | | | | | |
|---|---|---|---|---|---|---|---|---|
| | 1 minute | | 5 minutes | | 10 minutes | | 15 minutes | |
| | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) |
| Maximum | 18.80 | N/A | 39.77 | 23.60 | 45.11 | 20.89 | 62.30 | 34.25 |
| Minimum | 6.58 | | 7.14 | 8.59 | 30.00 | 14.23 | 40.85 | 20.00 |
| Measured | 15.75 | | 30.36 | 16.60 | 41.50 | 16.87 | 56.76 | 23.04 |
| Thickness | 7.20 | | 26.05 | 21.58 | 40.13 | 17.69 | 51.36 | 37.22 |
| Values | 14.50 | | 16.70 | | 40.07 | 16.23 | 61.75 | |
| | 8.50 | | 28.00 | | 34.89 | | 56.87 | |
| | 13.90 | | 37.32 | | 40.02 | | 59.03 | |
| | 10.12 | | 21.52 | | 41.26 | | 46.34 | |
| Average | 11.92 | 0 | 25.86 | 17.59 | 39.12 | 17.18 | 54.41 | 28.62 |

TABLE II

| | Time | | | | | | | |
|---|---|---|---|---|---|---|---|---|
| | 30 minutes | | 60 minutes | | 90 minutes | | 120 minutes | |
| | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) |
| Maximum | 108.80 | 96.00 | 124.08 | 57.24 | 142.00 | 90.96 | 160.45 | 113.94 |
| Minimum | 54.37 | 62.00 | 76.33 | 27.78 | 88.63 | 47.00 | 111.85 | 48.00 |
| Measured | 94.12 | 88.00 | 109.83 | 29.61 | 119.45 | 79.65 | 158.00 | 97.21 |
| Thickness | 105.37 | 92.50 | 83.42 | 48.92 | 134.83 | 79.34 | 155.35 | 71.20 |
| Values | 94.02 | 86.00 | 84.34 | 51.59 | 114.65 | 64.43 | 113.60 | 89.00 |
| | 96.04 | 78.15 | 106.2 | 39.57 | 115.95 | 49.38 | 129.47 | 76.87 |
| | 101.68 | | 84.81 | | 126.81 | | 115.25 | 100.90 |
| | 103.26 | | 86.99 | | 113.60 | | 128.20 | |
| Average | 94.70 | 58.77 | 94.75 | 42.45 | 119.49 | 68.46 | 134.02 | 85.30 |

Example 2

Effect of Current Density on Boride Layer Thickness

Figure 11:
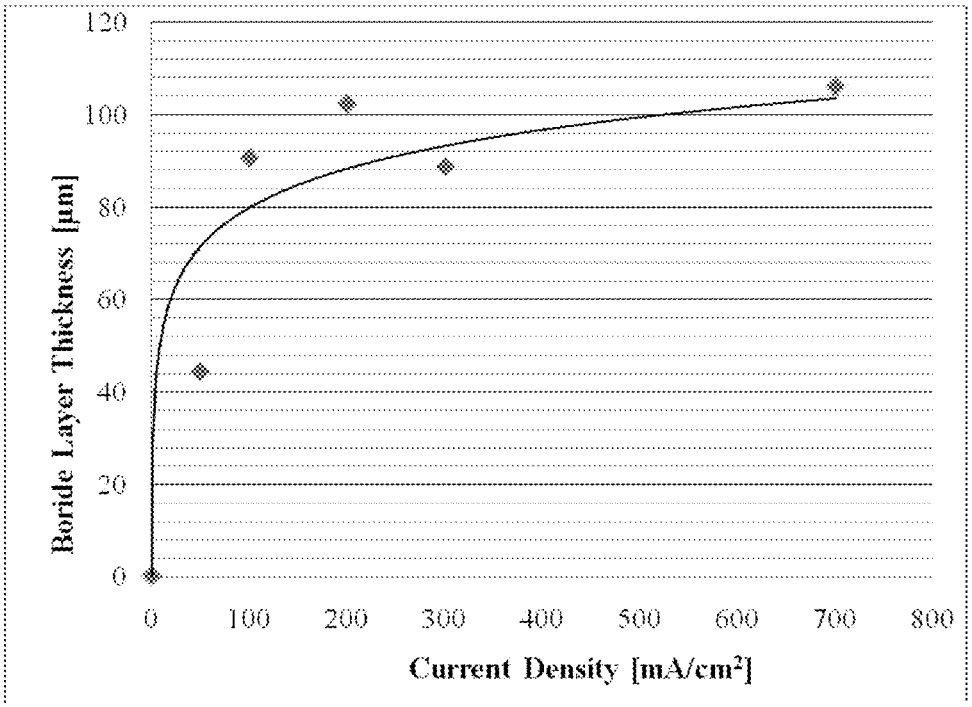
FIG. 11 shows the relationship between total borided layer thickness and current density (20% NaCl+80% $Na_2B_4O_7$, 1 hour, 900° C.)

In another example, the relationship was determined between current density and total borided and FeB layer thickness, as described in Table III below. (Electrolyte composition: % 20 NaCl+% 80 $Na_2B_4O_7$; Total process time: 1 hour; Temperature: 900° C.). The graphical appearance of boride layer thickness versus current density is shown in FIG. 11.

TABLE III

| | Current Density | | | | | | | | | |
|---|---|---|---|---|---|---|---|---|---|---|
| | 50 mA/cm$^2$ | | 100 mA/cm$^2$ | | 200 mA/cm$^2$ | | 300 mA/cm$^2$ | | 700 mA/cm$^2$ | |
| | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) |
| Maximum | 52.68 | N/A | 110.96 | 60.12 | 124.08 | 57.24 | 112.80 | 68.31 | 142.66 | 98.624 |
| Minimum | 20.04 | | 55.00 | 12.42 | 76.33 | 27.78 | 58.41 | 28.61 | 70.00 | 23.66 |
| Measured | 49.40 | | 97.00 | 50.00 | 109.83 | 29.62 | 111.36 | 65.97 | 96.00 | 67.71 |
| Thickness | 50.82 | | 103.00 | 35.80 | 83.42 | 48.92 | 69.67 | | 123.42 | 85.24 |
| Values | 48.00 | | 99.64 | 42.90 | 84.34 | 51.59 | 107.35 | | 120.00 | 80.00 |
| | 29.50 | | 63.54 | | 106.20 | 39.57 | 78.01 | | 90.77 | 65.00 |
| | 52.25 | | 93.86 | | 84.81 | | 103.07 | | 85.17 | |
| | 51.80 | | 102.30 | | 86.99 | | 68.73 | | 120.00 | |
| Average | 44.31 | 0 | 90.66 | 40.24 | 94.75 | 42.45 | 88.67 | 54.29 | 106.00 | 70.03 |

Example 3

Figure 12:
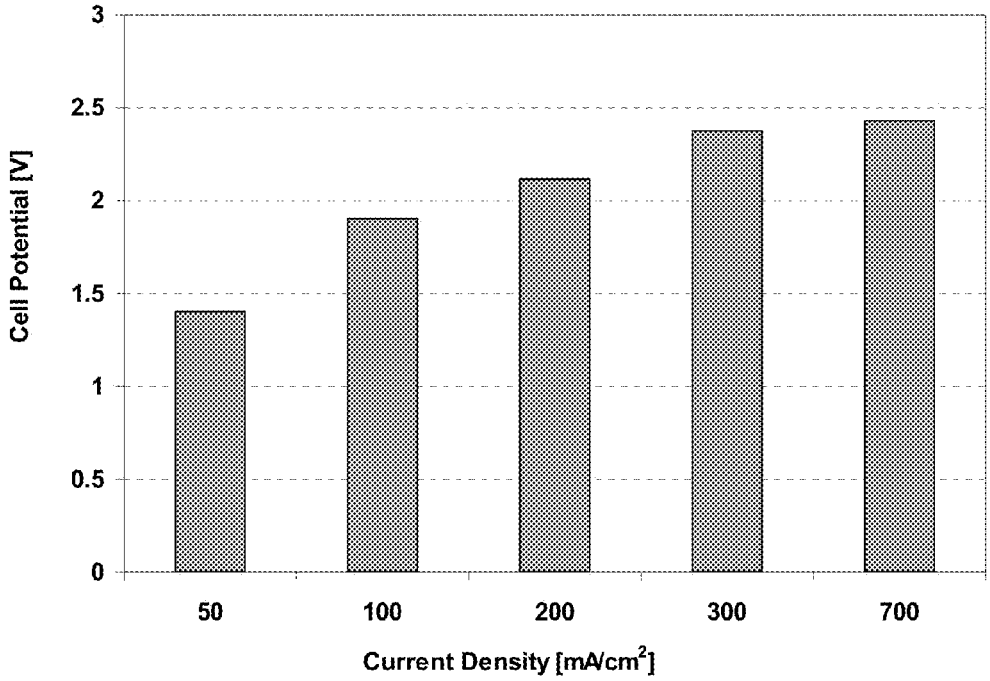
FIG. 12 shows the relationship between electrochemical cell potential and the current density (20% NaCl+80% $Na_2B_4O_7$, 1 hour, 900° C.)
Figure 13A:
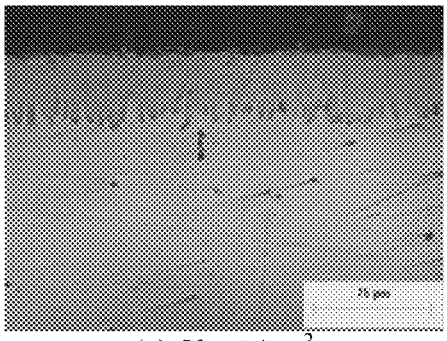
FIG. 13A shows a cross-sectional micrograph (400×) of boride layers produced by electrochemical boriding in 20% NaCl and 80% $Na_2B_4O_7$ for 1 hour at 900° C. and at 50 mA/cm2.
Figure 13B:
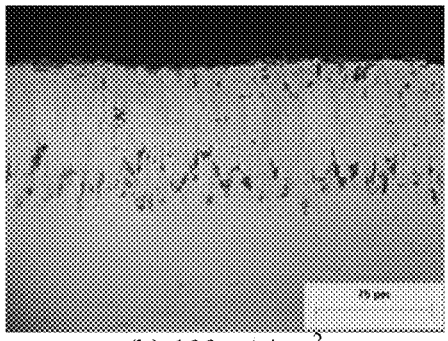
FIG. 13B is for 100 mA/cm$^2$.
Figure 13C:
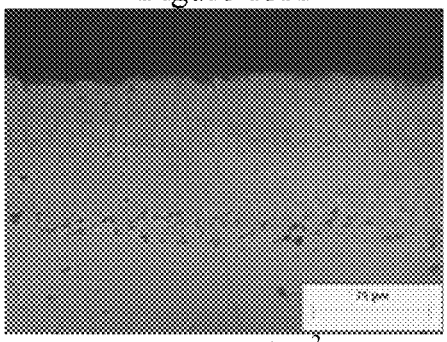
FIG. 13C for 200 mA/cm$^2$.
Figure 13D:
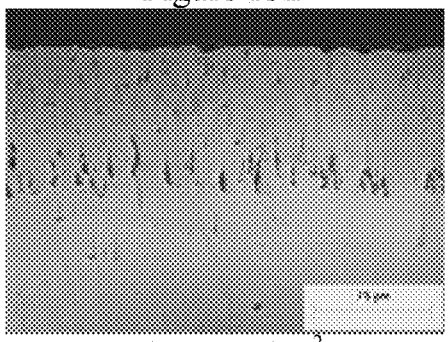
FIG. 13D for 300 mA/cm$^2$ and FIG. 13E for 700 mA/cm$^2$.
Figure 13E:
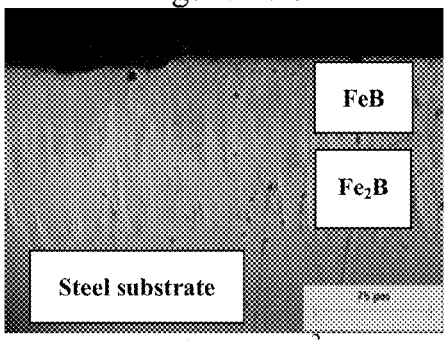
Figure 14:
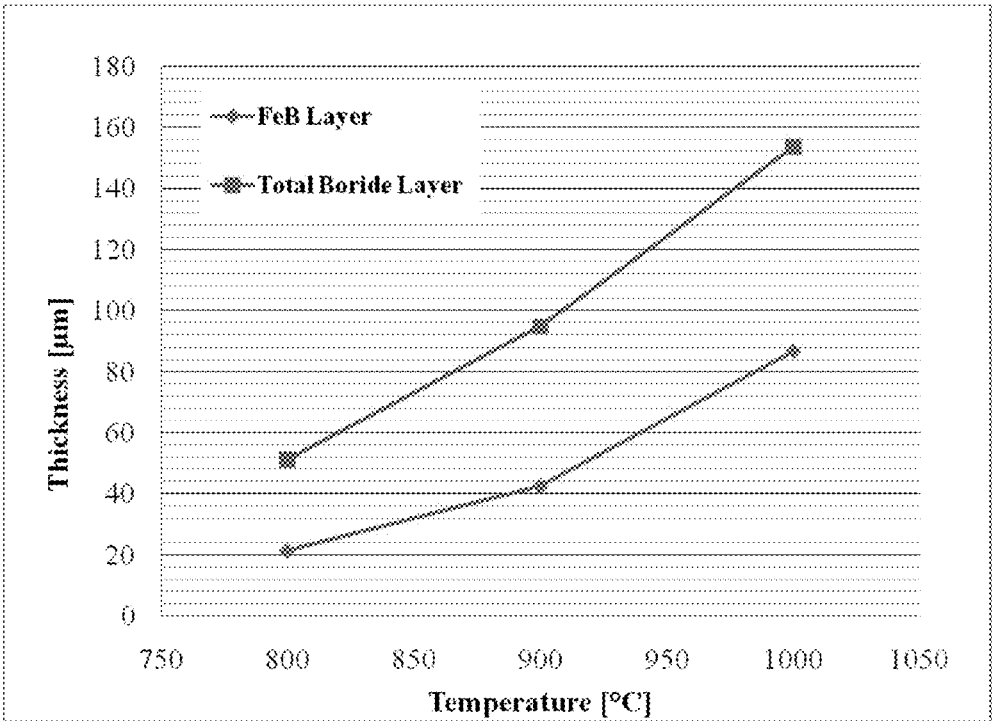
FIG. 14 shows dependence of total boride and FeB layer thicknesses to electrolyte temperature (10% NaCl+90% $Na_2B_4O_7$, 1 hour, 200 mA/cm$^2$)
Figure 15A:
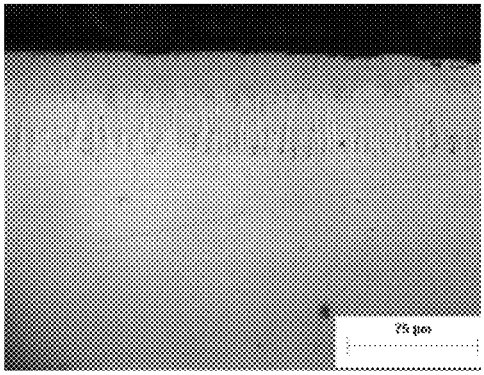
FIG. 15A shows a cross-sectional optical micrograph of a steel sample borided at 800° C. in a 10% NaCl plus 90% $Na_2B4O_7$ for 1 hour at 200 mA/cm$^2$.
Figure 15B:
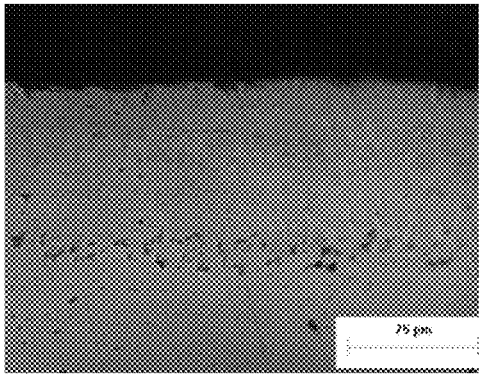
FIG. 15B is at 900° C.
Figure 15C:
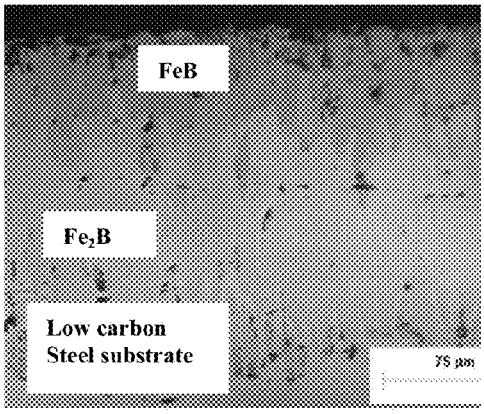
FIG. 15C at 1000° C.
Figure 16:
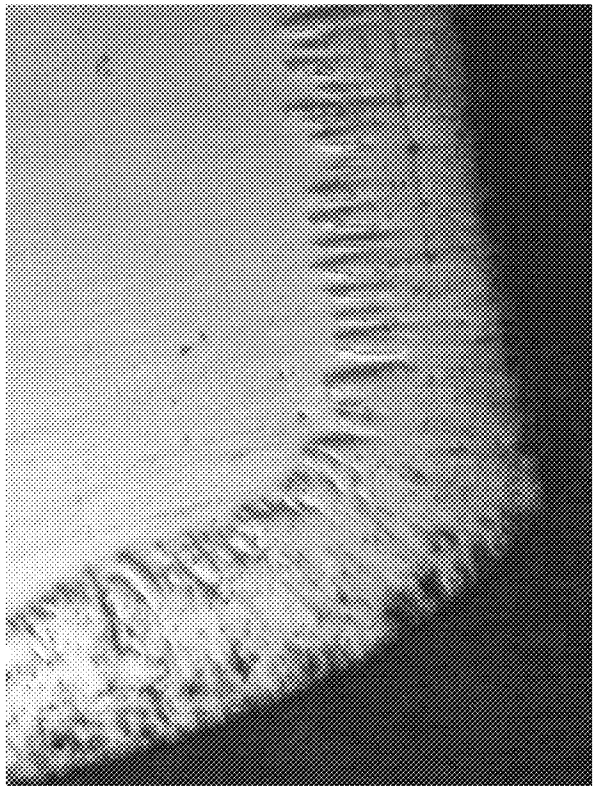
FIG. 16 is cross-sectional optical micrograph of the corner of a sample showing the morphology of boride layer formed at 1000° C. (Magnification: 100×), (10% NaCl+90% $Na_2B_4O_7$, 1 hour at 200 mA/cm$^2$)
Figure 17A:
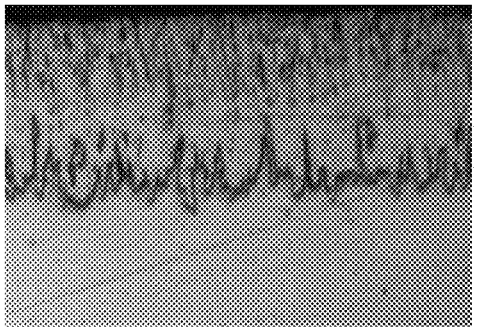
FIG. 17A shows a cross-sectional micrograph of a steel sample at $\eta=B_2O_3/Na_2O$ ratios=1.25 with a magnification of 100× treated at 900° C., 200 mA/cm$^2$ for 1 hour.
Figure 17B:
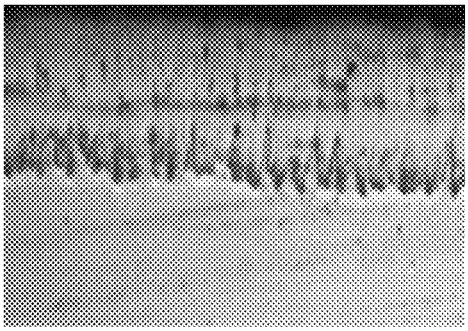
FIG. 17B is for $\eta$=1.5.
Figure 17C:
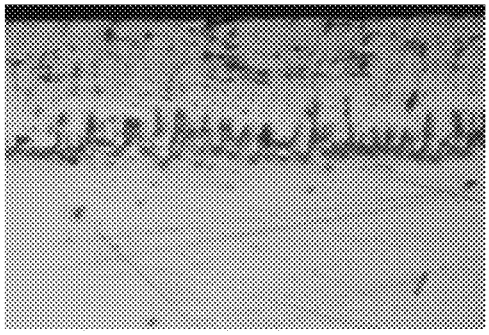
FIG. 17C is for $\eta$=1.75.
Figure 17D:
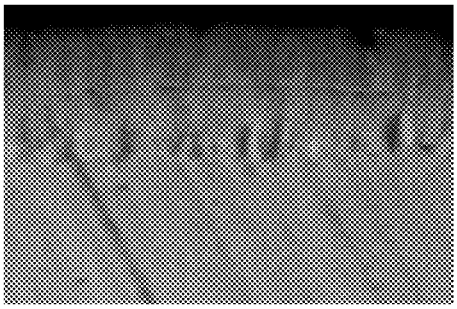
FIG. 17D is for $\eta$=1.87
Figure 17E:
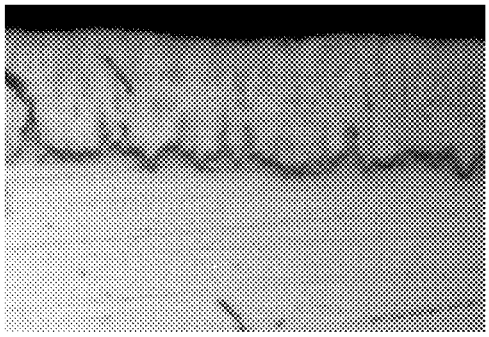
FIG. 17E is for $\eta$=2.245.
Figure 18:
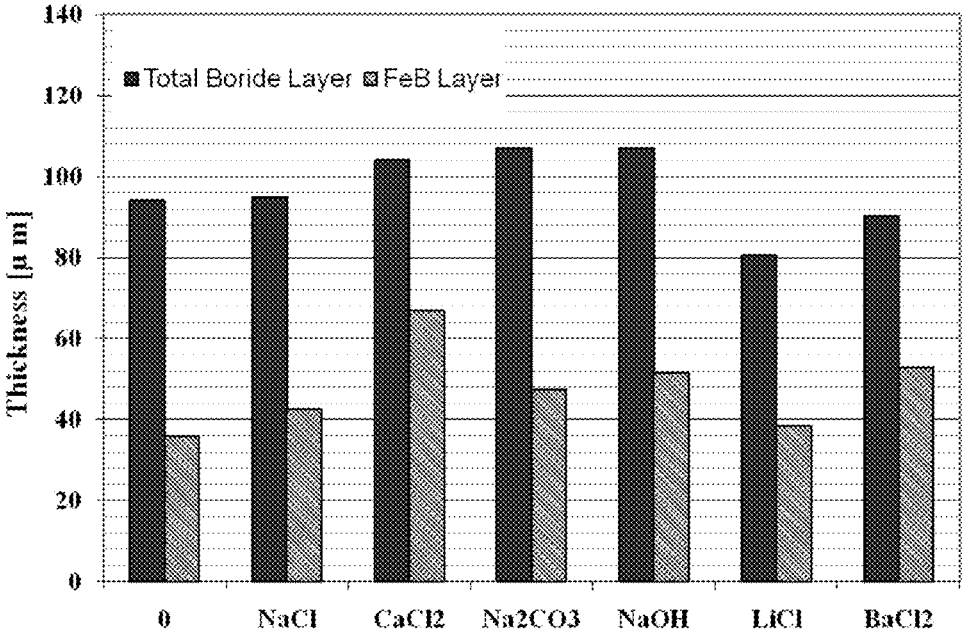
FIG. 18 shows the effect of different additives in electrolyte on thickness of borided and FeB layers (10% Additive+90% $Na_2B_4O_7$, 200 mA/cm$^2$, 900° C., 1 hour)
Figure 19A:
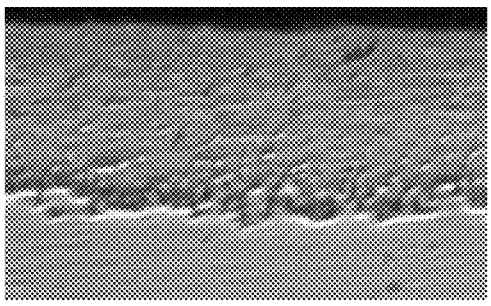
FIG. 19A shows cross-sectional micrographs at 100× of a steel sample borided by using a 10% NaCl additive treated at 200 mA/cm$^2$, 900° C. for 1 hour.
Figure 19B:
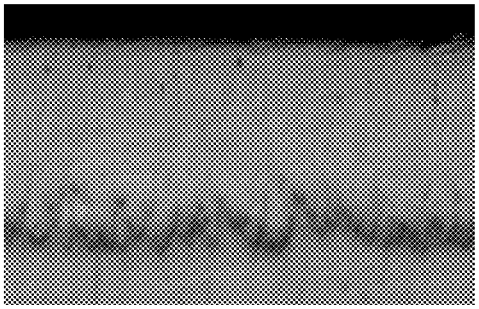
FIG. 19B is for 10% $CaCl_2$.
Figure 19C:
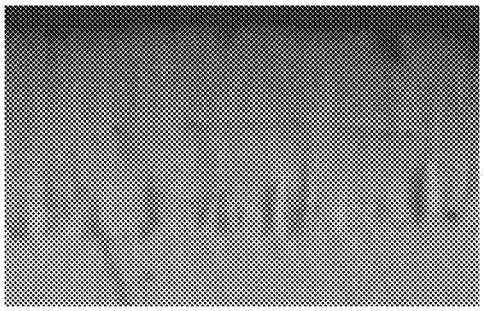
FIG. 19C is for 10% $Na_2CO_3$.
Figure 19D:
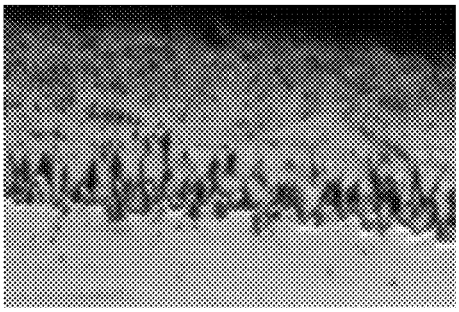
FIG. 19D is for 10% NaOH.
Figure 19E:
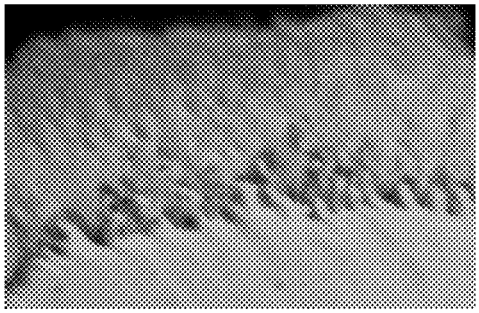
FIG. 19E is for 10% LiCl.
Figure 19F:
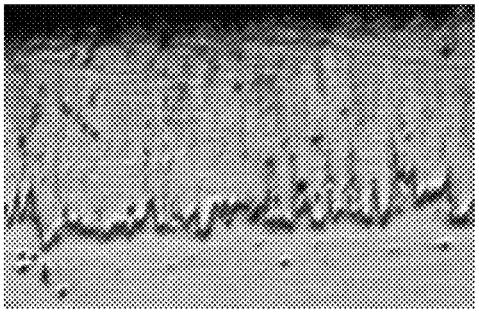
FIG. 19F is for 10% $BaCl_2$.
Figure 20:
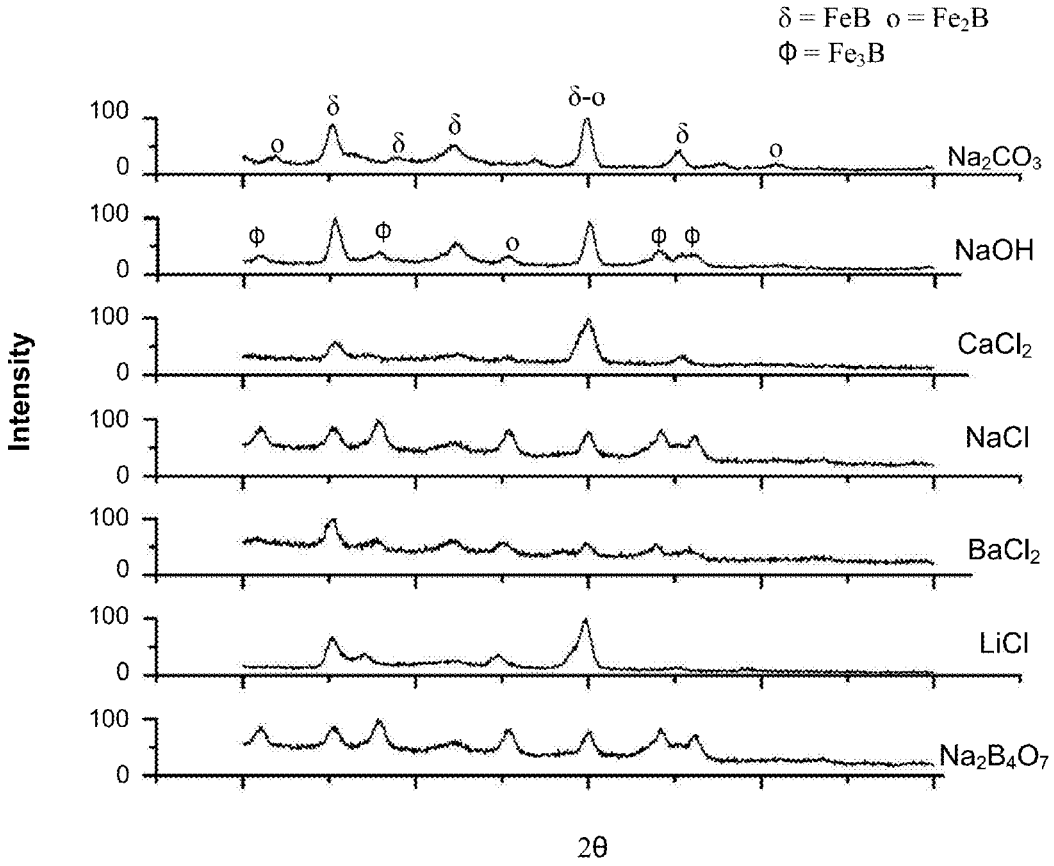
FIG. 20 shows X-ray diffraction spectra of low carbon steel sample that has been borided with different additives (10% Additive+90% $Na_2B_4O_7$, 200 mA/cm$^2$, 900° C., 1 hour)

Relationship Between Electrochemical Cell Potential and Current Density in Molten Electrolyte The relationship between cell potential and the current density (20% NaCl+80% $Na_2B_4O_7$, 1 hour, 900° C.) is illustrated in FIG. 12 from a set of measurements and cross sectional micrographs of the boride layers produced at different current densities are shown in FIGS. 13A-13E for various current densities for an electrolyte of 20% NaCl plus 80% $Na_2B_4O_7$ at 1 hour and 900° C. Cell potential directly related with resistivity of electrolyte, in general 1.5-6V cell potential is the expected range for the working current density applications. Depending on electrolyte resistance cell potential can be as high as 20V. In addition to direct current (DC), the cell potential may be applied in the radio-frequency (RF) (MHz range), bi-polar pulse DC (Hz to kHz range, different wave forms; e.g. square, sine, triangle sawtooth etc.), and high power impulse modes, or any other modes available. In particular, the use of pulse DC and RF may prevent any type of diffusion barriers forming on work piece surfaces and hence slowing down the boriding process.

Example 4

The Effect of Process (Boriding) Temperature on Borided Layer Thickness

The relationships between total borided and FeB layer thickness and electrolyte process temperature and micrographs (Electrolyte: 10% NaCl+90% $Na_2B_4O_7$; Process time: 1 hour, Current density: 200 mA/cm$^2$) are shown in Table IV and FIGS. 9, 14 and 15A-15C.

TABLE IV

| | Electrolyte Temperature | | | | | |
|---|---|---|---|---|---|---|
| | 800° C. | | | | | |
| | Total | | 900° C. | | 1000° C. | |
| | Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) |
| Maximum | 61.80 | 32.55 | 124.08 | 57.24 | 206.00 | 115.75 |
| Minimum | 27.40 | 11.50 | 76.33 | 27.78 | 90.50 | 35.79 |
| Measured | 53.00 | 27.21 | 109.83 | 29.61 | 169.00 | 106.60 |
| Thickness | 58.00 | 27.20 | 83.42 | 48.92 | 93.30 | 65.61 |
| Values | 61.75 | 17.54 | 84.34 | 51.59 | 161.00 | 97.35 |
| | 59.50 | 12.25 | 106.20 | 39.57 | 198.96 | 85.22 |

TABLE IV-continued

| | Electrolyte Temperature | | | | | |
|---|---|---|---|---|---|---|
| | 800° C. | | | | | |
| | Total | | 900° C. | | 1000° C. | |
| | Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) |
| | 36.60 | | 84.81 | | 144.58 | 136.00 |
| | 51.20 | | 86.99 | | 165.20 | 50.70 |
| Average | 51.15 | 21.37 | 94.75 | 42.45 | 153.56 | 86.63 |

Example 4

The Effect of B2O3/Na2O Ratio in Electrolyte on Total Boride and FeB Layer Thicknesses The relationship between $\eta=B_2O_3/Na_2O$ ratio and boride layer thickness (900° C., 200 mA/cm$^2$, 1 hour) is shown in Table V and FIGS. 8, 17A-17E.

TABLE V

| | η | | | | | | | | | |
|---|---|---|---|---|---|---|---|---|---|---|
| | η = 1.25 | | η = 1.5 | | η = 1.75 | | η = 1.87 | | η = 2.245 | |
| | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) |
| Maximum | 190.29 | 98.30 | 120.27 | 73.00 | 120.27 | 75.67 | 138.56 | 74.65 | 106.20 | 49.52 |
| Minimum | 113.00 | 36.00 | 88.00 | 45.00 | 86.71 | 35.00 | 81.25 | 26.24 | 72.21 | 21.26 |
| Measured | 166.79 | 60.80 | 119.63 | 72.318 | 103.87 | 66.50 | 112.58 | 48.70 | 73.00 | 48.18 |
| Thickness | 137.11 | 75.65 | 113.86 | 50.81 | 110.84 | 60.80 | 97.00 | 64.18 | 100.00 | 36.00 |
| Values | 166.78 | 72.50 | 95.90 | 68.85 | 110.74 | 38.00 | 119.20 | 31.00 | 105.13 | 24.03 |
| | 153.38 | 77.30 | 119.11 | 49.00 | 105.63 | 49.52 | 91.70 | 30.50 | 103.00 | 36.00 |
| | 169.56 | 50.00 | 110.00 | | 108.00 | 61.11 | 110.00 | 57.30 | 96.00 | |
| | 173.65 | | 118.12 | | 116.97 | | 106.00 | | 97.00 | |
| Average | 158.82 | 67.22 | 110.61 | 59.83 | 107.88 | 55.23 | 107.04 | 47.51 | 94.07 | 35.83 |

Example 5

The Effect of Electrolyte Composition on Boride Layer Thickness

Effect of different additives in electrolyte on thickness of borided layer (10% Additive+90% $Na_2B_4O_7$, 200 mA/cm$^2$, 900° C., 1 hour) and the results are shown in Table VI and VII and FIGS. 18, 19A-19F and 20. Hardness values of borided layers produced by using different additives, the hardness values are measured on a cross-sectional surface.

TABLE VI

| | Additives | | | | | | | | | | | |
|---|---|---|---|---|---|---|---|---|---|---|---|---|
| | | | | | | | | | | | NaOH | |
| | NaCl | | $CaCl_2$ | | LiCl | | $BaCl_2$ | | $Na_2CO_3$ | | Total | |
| | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Borided Layer Thickness (μm) | FeB Layer Thickness (μm) |
| Maximum | 124.08 | 57.24 | 127.06 | 81.60 | 106.67 | 53.00 | 113.08 | 75.63 | 138.56 | 74.65 | 110.94 | 59.30 |
| Minimum | 78.33 | 27.78 | 70.00 | 38.00 | 66.56 | 21.30 | 66.00 | 15.30 | 81.25 | 26.24 | 99.43 | 44.00 |

TABLE VI-continued

| | Additives | | | | | | | | | | | |
|---|---|---|---|---|---|---|---|---|---|---|---|---|
| | | | | | | | | | | | NaOH | |
| | NaCl | | $CaCl_2$ | | LiCl | | $BaCl_2$ | | $Na_2CO_3$ | | Total | |
| | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Total Borided Layer Thickness (μm) | FeB Layer Thickness (μm) | Borided Layer Thick-ness (μm) | FeB Layer Thick-ness (μm) |
| Measured | 109.83 | 29.61 | 115.60 | 78.00 | 77.76 | 46.66 | 104.43 | 71.49 | 112.58 | 48.70 | 104.35 | 50.50 |
| Thickness | 83.42 | 48.92 | 78.50 | 39.00 | 84.82 | 27.57 | 89.98 | 60.67 | 97.00 | 64.18 | 102.40 | 55.87 |
| Values | 84.34 | 51.59 | 124.13 | 65.32 | 78.40 | 36.00 | 90.54 | 56.52 | 119.20 | 31.00 | 105.68 | 48.00 |
| | 106.20 | 39.57 | 120.50 | 79.70 | 69.96 | 40.30 | 81.96 | 62.04 | 91.70 | 30.50 | 107.02 | |
| | 84.81 | | 110.90 | 86.00 | 77.29 | 52.68 | 75.26 | 34.05 | 110.00 | 57.30 | 110.67 | |
| | 86.99 | | 86.60 | | 82.12 | 30.00 | 100.49 | 46.37 | 106.00 | | 114.37 | |
| Average | 94.75 | 42.45 | 104.16 | 66.80 | 80.45 | 38.44 | 90.22 | 52.76 | 107.04 | 47.51 | 106.86 | 51.53 |

TABLE VII

| Additive | FeB | $Fe_2B$ | Load |
|---|---|---|---|
| Pure Borax | 1460 | 1120 | 100 g |
| NaCl | 1750 | 1340 | 100 g |
| $CaCl_2$ | 2074 | 1580 | 100 g |
| $Na_2CO_3$ | 1890 | 1572 | 100 g |
| NaOH | 1885 | 1595 | 100 g |
| LiCl | 1350 | 1205 | 25* g. |
| $BaCl_2$ | 1800 | 1412 | 100 g |

*low load used.

Example 6

Figure 21:
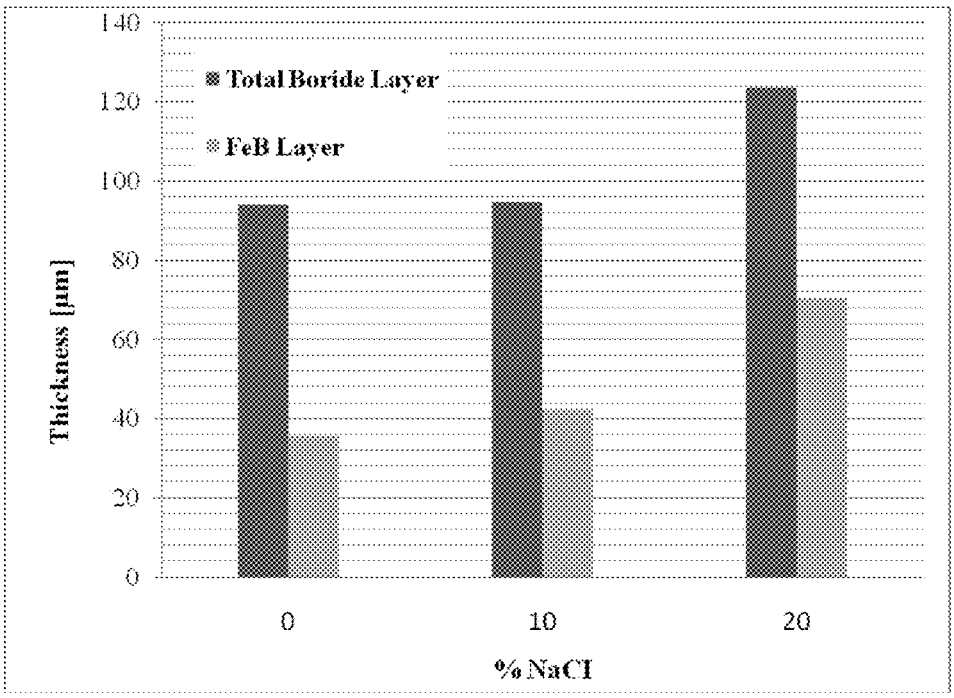
FIG. 21 shows total boride and FeB layer thickness dependence on NaCl concentration (Electrolyte composition: X % NaCl+100-X % $Na_2B_4O_7$; process time was 1 hour, and the current density was 200 mA/cm$^2$)
Figure 22:
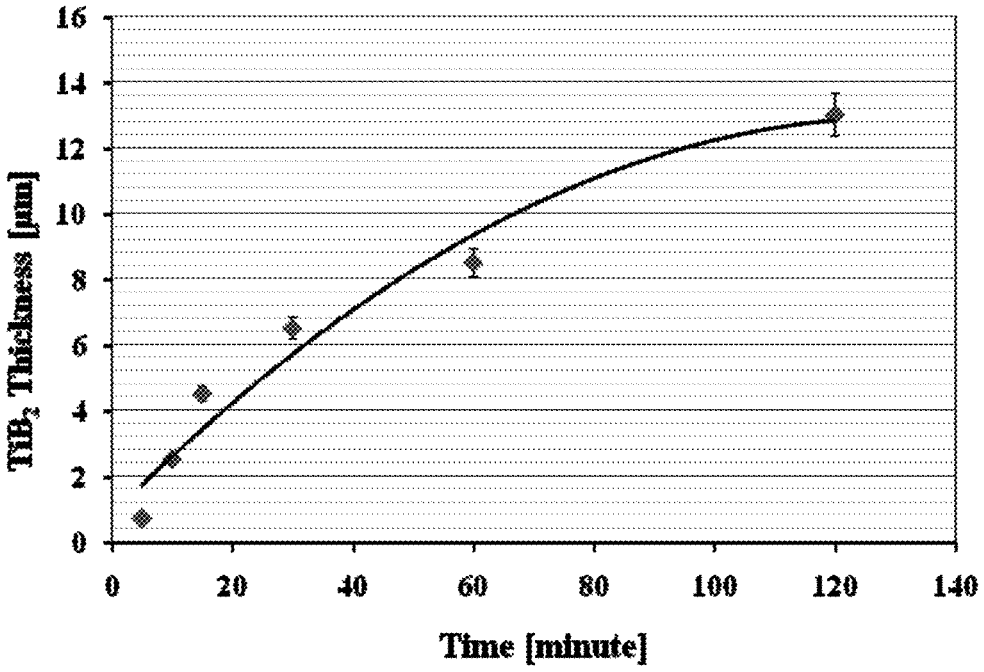
FIG. 22 shows the effect of bonding time on borided layer thickness on a 99.7% pure titanium substrate treated at 950° C., 300 mA/cm$^2$, 15% $Na_2CO_3$ and 85% $Na_2B_4O_7$.
Figure 23:
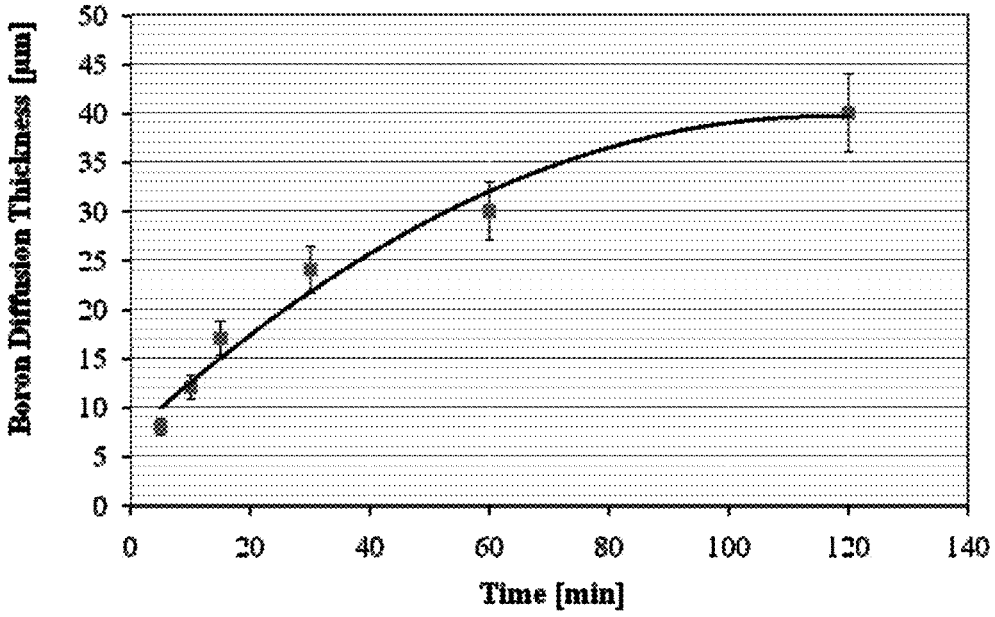
FIG. 23 shows the relationship between diffusion layer thickness and time for a Ti substrate (950° C., 300 mA/cm$^2$, 15% $Na_2CO_3$ ve 85% $Na_2B_4O_7$)
Figure 24A:
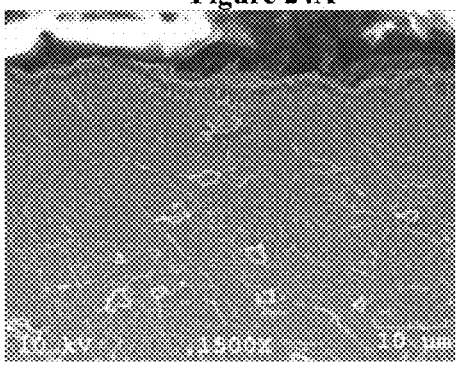
FIG. 24A shows a cross-sectional SEM micrograph at 1500× illustrating borided layers on titanium substrate after a process time of 5 minutes of boriding at 950° C., 300 mA/cm$^2$ using 15% $Na_2CO_3$ and 85% $Na_2B_4O_7$.
Figure 24B:
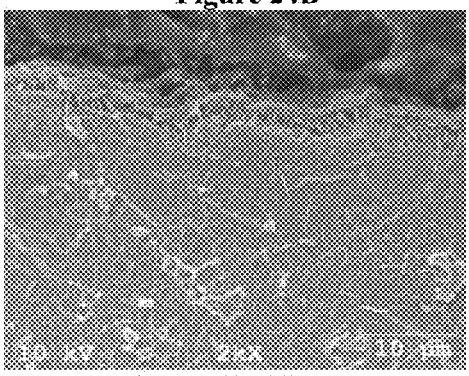
FIG. 24B is the same as FIG. 24A but at 2000×.
Figure 24C:
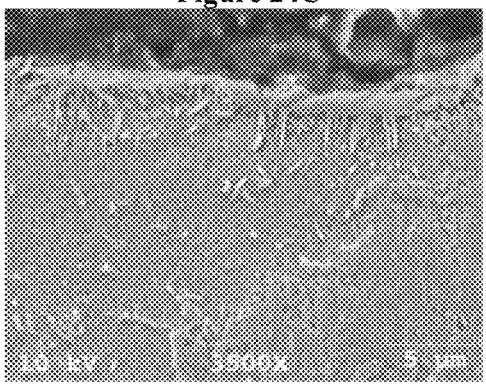
FIG. 24C is for 10 m boriding at 3500×.
Figure 24D:
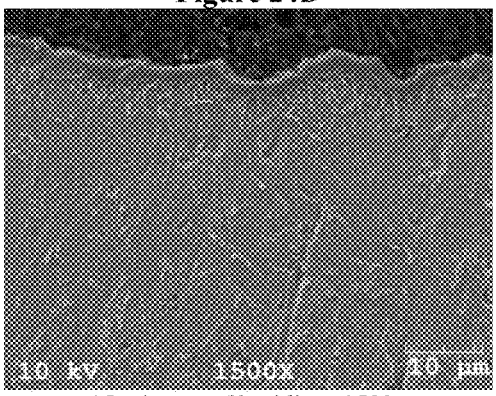
FIG. 24D is for 15 minutes boriding at 1500×.
Figure 24E:
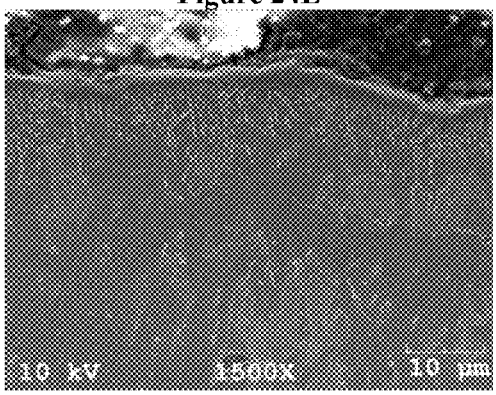
FIG. 24E is for 30 m of boriding at 1500×.
Figure 24F:
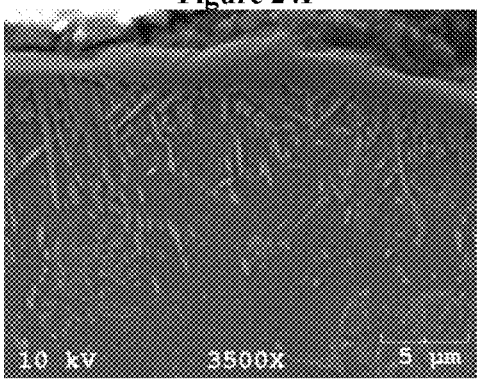
FIG. 24F is for 30 minutes of boriding at 3500×.
Figure 24G:
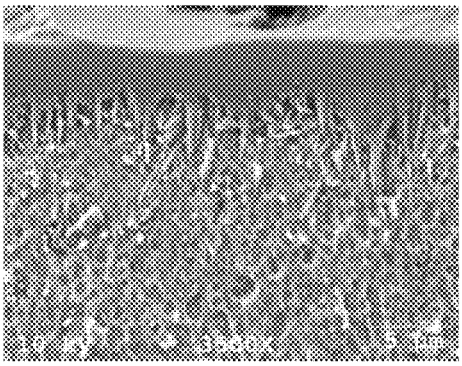
FIG. 24G is for 1 hour of boriding at 3500× and FIG. 24H is for 2 hours of boriding at 1500×.
Figure 24H:
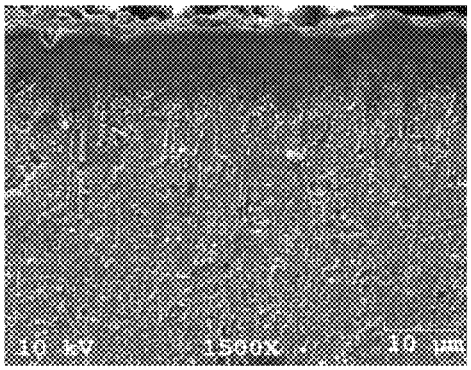
Figure 25:
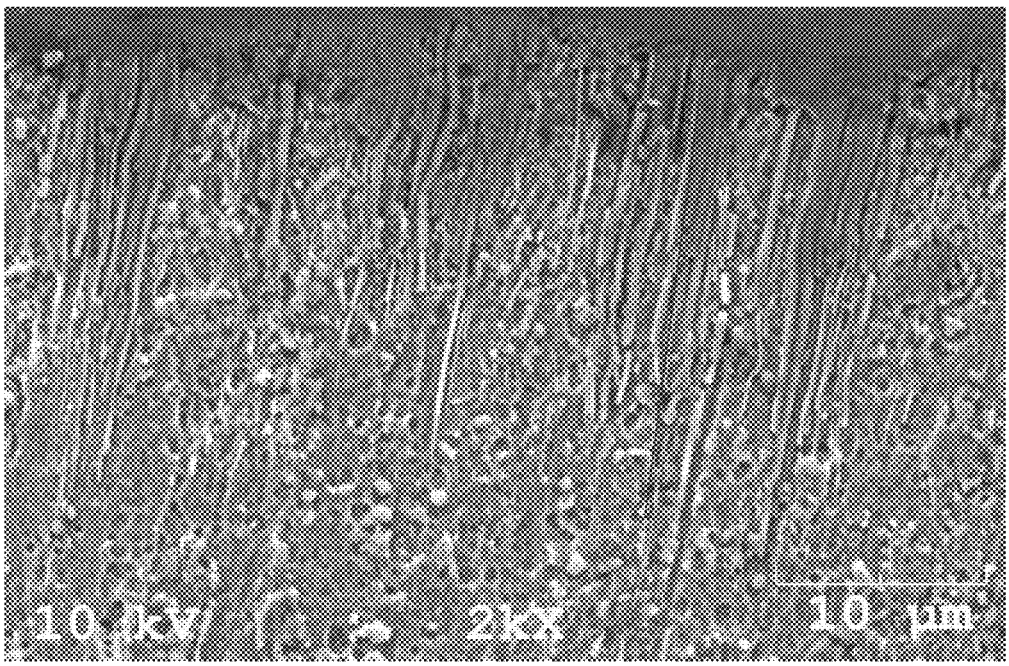
FIG. 25 shows a cross-sectional SEM micrograph with thin nano-structured long whiskers of TiBx grown inside of the titanium substrate (950° C., 300 mA/cm$^2$, 2 hours, 15% $Na_2CO_3$ ve 85% $Na_2B_4O_7$.

The Effect of NaCl as an Additive at Different Concentrations on Thickness of Borided Layers Bonded and FeB layer thickness dependence on NaCl additive concentration in electrolyte (Electrolyte composition: X % NaCl+100-X % $Na_2B_4O_7$; process time was 1 hour, and the current density was 200 mA/cm$^2$) and results shown in Table VIII and FIG. 21.

TABLE VIII

| | NaCl Ratio | | | | | |
|---|---|---|---|---|---|---|
| | | | 10% NaCl + 90% $Na_2B_4O_7$ | | 20% NaCl + 80% $Na_2B_4O_7$ | |
| | 100% $Na_2B_4O_7$ | | Total | | Total | |
| | Total Borided Layer Thickness (μm) | FeB Layer Thickness (μm) | Borided Layer Thick-ness (μm) | FeB Layer Thick-ness (μm) | Borided Layer Thick-ness (μm) | FeB Layer Thick-ness (μm) |
| Maximum | 106.19 | 49.51 | 124.08 | 57.24 | 145.00 | 96.67 |
| Minimum | 72.20 | 21.26 | 76.32 | 27.78 | 95.91 | 29.34 |
| Measured | 73.00 | 48.18 | 109.83 | 29.61 | 135.28 | 85.18 |
| Thickness | 100.00 | 36.00 | 83.42 | 48.92 | 125.97 | 83.02 |
| Values | 105.13 | 24.03 | 84.34 | 51.59 | 128.83 | 78.72 |
| | 103.00 | 36.00 | 106.2 | 39.57 | 121.74 | 49.40 |
| | 96.00 | | 84.81 | | 106.45 | |
| | 97.00 | | 86.99 | | 129.30 | |
| Average | 94.07 | 35.83 | 94.75 | 42.45 | 123.56 | 70.4 |

Example 7

Boriding of Non-Ferrous Material (Titanium)

Effect of boriding time on borided layer thickness on a 99.7% pure titanium substrate is shown in FIGS. 22-25. Process conditions and electrolyte compositions were: 950° C., 300 mA/cm$^2$, 15% $Na_2CO_3$ and 85% $Na_2B_4O_7$. The results with respect to borided time are shown in Table VIII and FIGS. 22, 23, 24A-24H and 25.

Example 8

Selective Boriding of Metal Surfaces

Figure 26:
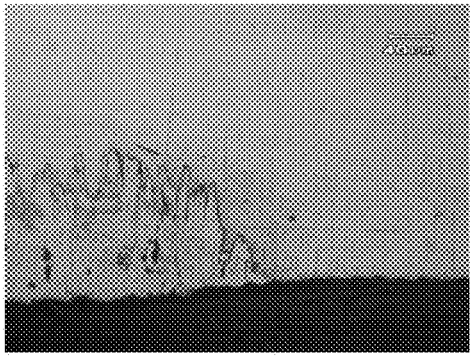
FIG. 26 shows an optical micrograph of a selectively borided 1045 steel surfaces (950° C., 300 mA/cm$^2$, 1 hour, 50 rpm, 15% $Na_2CO_3$+85% $Na_2B_4O_7$) and an area which was not borided that was masked by a thin metal sheet before immersing into electrolyte.

As shown in FIG. 26, metal surfaces can be masked selectively and only the areas that are not masked will be borided. In another method, a burner flame can be used to melt an electrolyte in a preferred area and then an electrochemical cell can be established on that area to selectively boride the area where the electrolyte is present. As shown, only the exposed surface was borided. The transition from the borided to the unborided surface is sharp (40 μm). This sharp transition cannot be achieved by traditional boriding processes and could be important for some applications. Various coating methods (such as electroless or electrochemical plating) can be used to deposit thin layers of copper or other metals to mask the areas where boriding is not desired.

As demonstrated from the Examples provided above, ultra-fast boriding can be achieved in both the ferrous and non-ferrous metals and alloys. These borided metals and alloys can be used in a variety of manufacturing, earthmoving, agricultural, aerospace, and transportation applications such as metal forming tools, fuel injectors, gears, bearings and some of the power- and drive-train applications in cars and tracks, blades and cutters used in agricultural, forestry, and earth-moving applications. Turbine and helicopter blades, impellers, mixers, and other components subject to wind, sand, and solid particle slurry erosion or abrasion can also be treated by the new method and protected. More specifically, these borided surface layers can prevent wear and scuffing between heavily loaded rolling, rotating, or sliding surfaces under lubricated sliding conditions which are typical of these mechanical components and others (like chain links used in conveyor belts and other heavy machinery such as earth-moving equipments etc). One of the most important features of these borided surfaces is their ability to function under severe loading conditions and provide low friction and wear with and without lubrication.

This new ultra-fast boriding process can also be used to boride the pre-carburized and nitrided surfaces. In the case of pre-carburized steel surfaces, a compound layer consisting of not only iron borides but also boron carbides, free boron and carbon are also formed. In the case of pre-nitrided surfaces, a compound layer consisting of not only iron borides but also boron nitride and free boron are produced. Surfaces that are ion-implanted, or laser-cladded, and alloyed with various elements may also be borided by the new technique and the borides of such elements formed during boriding can then provide greater hardness and other desirable properties such as low friction and wear and greater protection against corrosion and erosion as well a better biocompatibility and/or reactivity.

Ultra-fast boriding is environmentally benign and there are no toxic raw materials involved and by-products to discard or deal with after the boriding process. The process also does not produce any fumes or green-house gases. In the other boriding processes new baths are needed and the old ones must be discarded properly and in the case of gas-phase boriding, there are some toxic gases that need to be handled carefully. One of the other advantages of the new process is that the electrolyte can be re-used multiple times. There is no need to discard and re-supply active ingredients (except for the boron compounds). Again, the new process is environmentally benign and there are no toxic by-products to discard or deal with. In the new process, there is little deposit to clean from the borided surface, remaining deposits (mainly salts) are washed away in running water or removed by mechanical brushes or tumbling in a sand box.

While several different features and embodiments are described above, it is understood that changes and modifications can be made to the invention without departing from the invention's broader aspects. Therefore, the present invention is not limited to the described and illustrated embodiments, but only by the scope and spirit of the independent and dependent claims.

What is claimed:

1. A method of boriding a surface of a metal in a system having a furnace, the improvement comprising:

providing an anode and a cathode of an electrochemical cell;

providing a metal component having a metal surface and coupling the metal component to the cathode;

providing a molten electrolyte comprising a boron compound and an additive selected from the group consisting of inorganic sodium, potassium, and lithium compounds therein;

providing an electrochemical boriding system including a furnace;

providing a current to the metal component;

operating the furnace to establish a high temperature for the molten electrolyte;

immersing the metal component in a bath of the molten electrolyte;

boriding the metal surface of the metal component immersed in the molten electrolyte to achieve a layer comprising $Fe_2B$ and FeB on the entire metal surface; and leaving the metal component for 10 minutes to 120 minutes in the molten electrolyte without applying current to the metal component while maintaining the high temperature of the molten electrolyte to controllably remove at least a portion of the FeB from the metal component.

2. The method as defined in claim 1 wherein control of rate of removal of the FeB in the step of leaving the metal component in the molten electrolyte without applying a further current includes control of current density, applied voltage, temperature of the molten electrolyte, duration of the boriding step and chemical composition of the molten electrolyte.

3. The method as defined in claim 1, wherein the boron compound comprise a borax.

4. The method as defined in claim 3, wherein the borax ranges from about 30 to about 95 weight percent.

5. The method as defined in claim 4, further including sodium carbonate ranging between about 5-70 weight percent.

6. The method as defined in claim 3, further including a second additive selected from the group consisting of an alkaline halide and an alkaline earth halide.

7. The method as defined in claim 1, further comprising increasing the boron concentration in the molten electrolyte to accelerate diffusion of boron ions, thereby accelerating boride layer growth on the metal surface.

8. The method as defined in claim 1, wherein the electrochemical boriding system includes a separation distance between the anode and cathode which is adjusted to accelerate the rate of forming a boride on the metal surface.

9. The method as defined in claim 1, further including a step of agitating the electrolyte to increase the rate of boriding the metal surface.

10. The method as defined in claim 1, wherein the metal component comprises a steel and the method further includes a step of quenching the metal component from the high temperature of the furnace, thereby forming martensitic phases beneath the boride layer proximate the metal surface.

11. The method as defined in claim 1 further including the step of quenching the metal component without further heat treatment.

12. The method as defined in claim 1 wherein the anode is selected from the group of metallic and boride forms of metals selected from the group of Ti, Al, Zr, Hf, V, Nb, Ta, Ni, Mo, Cr, W, Cu, Fe and alloys thereof.

13. The method as defined in claim 12 further including the step of forming a thin boride layer on a surface of the anode by a step of reverse polarization of the anode and the cathode.

14. The method as defined in claim 1 wherein the metal component is selected from the group of a ferrous metal component, a non-ferrous metal component and alloys thereof.

15. A method of boriding a surface of a metal in a system having a furnace, the improvement comprising:

providing an anode and a cathode of an electrochemical cell;

providing a metal component having a metal surface and coupling the metal component to the cathode;

providing a molten electrolyte comprising a boron compound and an additive selected from the group consisting of inorganic sodium, potassium, and lithium compounds therein;

providing a second additive comprising an alkali or alkaline earth metal that increases the ratio of $B_2O_3$ to $Na_2O$;

providing an electrochemical boriding system including a furnace;

providing a current to the metal component;

operating the furnace to establish a high temperature between about 700 and about 1000° C. for the molten electrolyte;

immersing the metal component in a bath of the molten electrolyte with the current applied for 5 minutes to 120 minutes at the high temperature and agitating the surface to accelerate the boriding, thereby completing the boriding of the metal surface forming rapidly a thick layer of a boride comprising $Fe_2B$ and FeB on the entire metal surface;

removing the current from the metal component;

leaving the metal component for 10 minutes to 120 minutes in the molten electrolyte without current while maintaining the high temperature of the molten electrolyte, removing the FeB from the metal surface.

16. The method as defined in claim 15 wherein removal of the FeB includes control of current density, applied voltage, temperature of the molten electrolyte, duration of the boriding step and chemical composition of the molten electrolyte.

17. The method as defined in claim 15 wherein the step of agitating the surface comprises agitating the electrolyte.

18. The method as defined in claim 15 wherein the metal component is selected from the group of a ferrous metal component, a non-ferrous metal component and alloys thereof.

19. The method of claim 15, wherein the boron compound is present in an amount of 30 to 95 wt %, the first additive is present in an amount of 0.1 to 5 wt %, and second additive is present in an amount of 5 to 70 wt %.

20. The method of claim 8, wherein the distance between the anode and cathode is 1 cm.

* * * * *